US010856668B2

(12) United States Patent
Ye et al.

(10) Patent No.: US 10,856,668 B2
(45) Date of Patent: Dec. 8, 2020

(54) MATTRESS OVERLAY CONTROL SYSTEM WITH ROTARY VALVES AND GRAPHICAL USER INTERFACE FOR PERCUSSION AND VIBRATION, TURN ASSIST AND MICROCLIMATE MANAGEMENT

(71) Applicant: Hill-Rom Services, Inc., Batesville, IN (US)

(72) Inventors: Chau Chong Ye, Singapore (SG); Yue Wang, Singapore (SG); Deny D. Barilea, Singapore (SG); Joshua A. Williams, West Harrison, OH (US); Suresha Venkataraya, Singapore (SG); Amodh Gundlur Ramesh, Banglore (IN); Catherine Wagner, Osgood, IN (US); Michael Hoksbergen, Auckland (NZ); Graham K. Lacy, London (GB)

(73) Assignee: Hill-Rom Services, Inc., Batesville, IN (US)

( * ) Notice: Subject to any disclaimer, the term of this patent is extended or adjusted under 35 U.S.C. 154(b) by 312 days.

(21) Appl. No.: 15/935,837

(22) Filed: Mar. 26, 2018

(65) Prior Publication Data

US 2018/0289174 A1 Oct. 11, 2018

Related U.S. Application Data

(60) Provisional application No. 62/483,636, filed on Apr. 10, 2017.

(51) Int. Cl.
*A47C 27/08* (2006.01)
*A47C 27/10* (2006.01)
(Continued)

(52) U.S. Cl.
CPC ..... *A47C 27/083* (2013.01); *A47C 21/006* (2013.01); *A47C 27/082* (2013.01);
(Continued)

(58) Field of Classification Search
CPC ... A47C 27/083; A47C 27/082; A47C 21/006; A47C 27/10; A61G 7/05776;
(Continued)

(56) References Cited

U.S. PATENT DOCUMENTS 1,772,310 A * 8/1930 Hart ..... A61G 7/001 5/713
2,452,292 A * 10/1948 Cousino ..... F15B 11/0325 60/560

(Continued)

*Primary Examiner* — Nicholas F Polito
*Assistant Examiner* — Luke Hall
(74) *Attorney, Agent, or Firm* — Barnes & Thornburg LLP

(57) ABSTRACT

A mattress overlay apparatus is provided for use with a mattress. The mattress overlay apparatus includes an overlay configured for placement atop the mattress and having a plurality of inflatable bladders, a blower, and first and second rotary plate valves pneumatically coupled to the plurality of bladders and the blower. The first and second rotary plate valves are arranged in series between the plurality of bladders and the blower. The first and second rotary plate valves and the blower are operated to provide the overlay with percussion and vibration (P&V), left and right turn assist, and microclimate management (MCM) functionality.

20 Claims, 17 Drawing Sheets

(51) Int. Cl.
*A47C 21/00* (2006.01)
*A61G 7/057* (2006.01)

(52) U.S. Cl.
CPC ..... *A47C 27/10* (2013.01); *A61G 7/05776* (2013.01); *A61G 7/05784* (2016.11); *A61G 2203/20* (2013.01)

(58) Field of Classification Search
CPC ..... A61G 7/05784; A61G 2203/20; Y10T 137/86501; Y10T 137/86509; Y10T 137/86517; Y10T 137/86533; Y10T 137/86549; Y10T 137/86863; Y10T 137/86911; Y10T 137/87917; F16K 11/20; F16K 11/22
USPC ..... 5/710
See application file for complete search history.

(56) References Cited

U.S. PATENT DOCUMENTS 2,700,280 A * 1/1955 Heuser ..... F25C 5/10 62/73
2,800,980 A * 7/1957 Flockhart ..... B60T 13/403 303/15
2,910,050 A * 10/1959 Dotter ..... F16K 11/0712 137/625.66
2,944,627 A * 7/1960 Skarstrom ..... B01D 53/047 95/26
3,076,477 A * 2/1963 Brandenberg ..... F16K 31/365 137/625.6
3,119,552 A * 1/1964 Thomann ..... F04D 27/0253 417/19
3,148,391 A * 9/1964 Whitney ..... A61G 7/05776 5/422
3,177,899 A * 4/1965 Anderson ..... F16K 11/072 137/625.29
3,279,087 A * 10/1966 Hearne ..... C08F 6/008 34/380
3,331,304 A * 7/1967 Baus ..... F04D 25/12 454/309
3,396,904 A * 8/1968 Janette ..... F04D 29/4213 251/78
3,426,856 A * 2/1969 Adams ..... B25D 9/145 173/203
3,446,203 A * 5/1969 Murray ..... A61G 7/05776 601/18
3,462,778 A * 8/1969 Whitney ..... A61G 7/05776 5/713
3,467,081 A * 9/1969 Glass ..... A61H 9/0078 601/148
3,485,240 A * 12/1969 Fountain ..... A61G 7/001 601/148
3,495,604 A * 2/1970 Trask ..... F15C 5/00 137/15.01
3,502,026 A * 3/1970 Toyoda ..... F04B 17/04 417/32
3,531,225 A * 9/1970 Woodling ..... F04C 2/104 418/61.3
3,531,226 A * 9/1970 Woodling ..... F04C 2/104 418/61.3
3,628,614 A * 12/1971 Brennan ..... E21B 7/024 173/29
3,653,083 A * 4/1972 Lapidus ..... A47C 27/081 5/713
3,678,520 A * 7/1972 Evans ..... A61G 7/05776 5/713
3,757,366 A 9/1973 Sacher
3,889,468 A * 6/1975 Blumer ..... B60T 13/165 60/548
3,908,642 A * 9/1975 Vinmont ..... A61F 13/046 601/149
3,919,730 A * 11/1975 Regan ..... A61G 7/05776 5/710
4,130,268 A * 12/1978 Kojima ..... B65D 90/582 251/298
4,135,500 A * 1/1979 Gorran ..... A47C 27/085 5/674
4,136,032 A * 1/1979 Bakken ..... B01J 49/75 137/599.14
4,197,837 A * 4/1980 Tringali ..... A61G 7/05776 137/565.27
4,225,989 A * 10/1980 Corbett ..... A61G 7/05776 5/710
4,311,135 A * 1/1982 Brueckner ..... A61H 9/0078 601/150
D266,470 S * 10/1982 Gammons ..... D24/184
4,368,012 A * 1/1983 Woodling ..... F04C 2/105 137/625.21
4,391,009 A 7/1983 Schild et al.
4,508,107 A * 4/1985 Strom ..... A61H 23/04 601/107
4,519,146 A * 5/1985 Herrington ..... B29C 48/913 34/104
4,522,374 A * 6/1985 Neff ..... B29C 45/14 137/375
4,527,591 A * 7/1985 Bacardit ..... B62D 5/083 137/625.21
4,583,255 A * 4/1986 Mogaki ..... A61H 9/0078 5/419
4,745,647 A * 5/1988 Goodwin ..... A61G 7/015 5/618
4,768,249 A * 9/1988 Goodwin ..... A61G 7/05776 5/713
4,823,842 A * 4/1989 Toliusis ..... F15B 13/0405 137/625.26
4,825,486 A * 5/1989 Kimura ..... A61G 7/05776 5/713
4,838,263 A * 6/1989 Warwick ..... A61H 9/0078 601/44
4,925,371 A * 5/1990 Griesmar ..... F04B 13/00 417/18
4,977,889 A * 12/1990 Budd ..... A61B 5/087 601/44
5,009,579 A * 4/1991 Grant ..... F04B 39/0033 417/12
5,035,016 A * 7/1991 Mori ..... A61G 7/05776 5/713
5,052,067 A * 10/1991 Thomas ..... A61G 7/001 137/625.64
5,056,505 A * 10/1991 Warwick ..... A61H 9/0078 601/44
5,095,568 A * 3/1992 Thomas ..... A61G 7/05776 5/713
5,103,518 A * 4/1992 Gilroy ..... A61G 7/05776 5/713
5,121,513 A * 6/1992 Thomas ..... A61G 7/001 137/884
5,142,719 A * 9/1992 Vrzalik ..... A61G 7/001 5/609
5,152,021 A * 10/1992 Vrzalik ..... A61G 7/001 5/713
5,152,319 A * 10/1992 Hannagan ..... A61G 7/05776 137/102
5,182,826 A * 2/1993 Thomas ..... A61G 7/001 417/12
5,189,742 A * 3/1993 Schild ..... A61G 7/05776 5/713
5,233,974 A * 8/1993 Senoue ..... A61H 9/0078 5/713
5,243,721 A * 9/1993 Teasdale ..... A61G 7/05776 5/710
5,251,349 A * 10/1993 Thomas ..... A61G 7/001 5/713
5,343,893 A * 9/1994 Hogan ..... A61G 7/05776 137/624.13
5,379,471 A * 1/1995 Holdredge ..... A61G 5/1043 297/DIG. 8
5,453,081 A * 9/1995 Hansen ..... A61H 9/0078 601/149

(56) References Cited

U.S. PATENT DOCUMENTS 5,529,026 A * 6/1996 Kurr ..... B60H 1/00485 123/41.1
5,533,217 A * 7/1996 Holdredge ..... A61G 5/1043 5/710
5,564,142 A * 10/1996 Liu ..... A61G 7/05776 5/689
5,569,170 A * 10/1996 Hansen ..... A61H 9/0078 601/149
5,584,085 A * 12/1996 Banko ..... A61G 7/05776 5/710
5,594,963 A * 1/1997 Berkowitz ..... A61G 7/05769 5/713
5,606,754 A * 3/1997 Hand ..... A61G 7/05776 5/713
5,611,096 A * 3/1997 Bartlett ..... A61G 7/001 5/424
5,611,671 A * 3/1997 Tripp, Jr. ..... E21B 43/121 417/118
5,611,772 A * 3/1997 Fujimoto ..... A61H 9/0078 601/149
5,651,151 A * 7/1997 Schild ..... A61G 7/05776 5/710
5,752,541 A * 5/1998 Gonzalez ..... E03C 1/0403 137/119.04
5,769,797 A * 6/1998 Van Brunt ..... A61H 9/0078 601/152
5,799,562 A * 9/1998 Weinberg ..... F01B 3/02 60/414
5,963,997 A * 10/1999 Hagopian ..... A61G 7/05776 5/654
5,983,428 A * 11/1999 Hannagan ..... A61G 7/05776 5/710
5,983,429 A * 11/1999 Stacy ..... A61G 7/05769 5/713
5,997,488 A * 12/1999 Gelfand ..... A61H 9/0078 601/152
6,019,011 A * 2/2000 Monette ..... F16H 61/0276 137/625.69
6,036,662 A * 3/2000 Van Brunt ..... A61H 9/0078 601/152
6,058,538 A * 5/2000 Chapman ..... A61G 7/05776 5/713
6,108,843 A * 8/2000 Suzuki ..... A47C 27/082 5/713
6,131,878 A * 10/2000 Horstmann ..... F15B 15/261 251/12
6,134,732 A * 10/2000 Chapman ..... A61G 7/05776 5/710
6,152,176 A * 11/2000 Lin ..... A61G 7/05776 137/624.11
6,182,658 B1 * 2/2001 Hayek ..... F16K 11/085 128/205.24
6,192,922 B1 * 2/2001 MacGibbon ..... F16K 3/085 137/486
6,202,672 B1 * 3/2001 Ellis ..... A47C 27/082 137/223
6,253,402 B1 * 7/2001 Lin ..... A61G 7/001 137/625.21
6,254,556 B1 * 7/2001 Hansen ..... A61H 9/0078 137/565.16
6,266,833 B1 * 7/2001 Lin ..... A61G 7/001 137/625.21
6,267,739 B1 * 7/2001 Cengarle ..... A61H 9/0078 5/710
6,412,129 B1 * 7/2002 Wu ..... A61G 7/05776 5/710
6,415,814 B1 * 7/2002 Hand ..... A61G 7/05776 137/487.5
6,547,749 B2 * 4/2003 Hansen ..... A61H 9/0078 417/244
6,550,439 B1 * 4/2003 Fischer ..... F02B 27/0257 123/184.47
6,571,412 B1 * 6/2003 Wu ..... A47C 27/081 5/658
6,571,825 B2 * 6/2003 Stacy ..... A61G 7/05776 137/624.13
6,611,979 B2 * 9/2003 Welling ..... A61G 7/0528 5/624
6,671,911 B1 * 1/2004 Hill ..... A61G 5/1043 5/655.3
6,676,614 B1 * 1/2004 Hansen ..... A61H 9/0078 601/41
6,698,046 B1 * 3/2004 Wu ..... A47C 27/082 137/625.15
6,711,771 B2 * 3/2004 Cook ..... A61G 7/05776 5/706
6,745,996 B1 * 6/2004 Guthrie ..... F16K 11/074 137/624.12
D498,518 S * 11/2004 Plath ..... D23/233
D499,173 S * 11/2004 Plath ..... D23/233
6,829,796 B2 * 12/2004 Salvatini ..... A61G 7/05776 5/706
6,832,629 B2 * 12/2004 Wu ..... F04D 25/084 137/625.21
6,832,630 B2 * 12/2004 Wu ..... A47C 27/082 137/554
6,859,967 B2 3/2005 Harrison et al.
6,867,383 B1 * 3/2005 Currier ..... H01H 35/34 200/83 R
6,928,681 B1 * 8/2005 Stacy ..... A61G 7/05776 5/710
6,958,046 B2 * 10/2005 Warwick ..... A61H 23/04 601/148
7,111,642 B2 * 9/2006 Takeda ..... F16K 31/0655 137/614.21
7,197,943 B2 * 4/2007 Lee ..... G01F 1/44 73/861.63
7,219,380 B2 * 5/2007 Beck ..... A61G 7/05776 137/625.46
7,316,658 B2 * 1/2008 Gagne ..... A61H 23/04 601/41
7,330,127 B2 * 2/2008 Price ..... A61B 5/0205 340/666
7,444,997 B2 * 11/2008 Hill ..... F02M 25/0836 123/520
7,469,432 B2 12/2008 Chambers
7,597,670 B2 * 10/2009 Warwick ..... A61H 9/0078 601/151
7,762,967 B2 * 7/2010 Warwick ..... A61H 9/0078 601/151
7,784,131 B2 * 8/2010 Genaro ..... A61G 7/05776 5/710
7,883,478 B2 * 2/2011 Skinner ..... A61G 7/05769 5/655.3
7,886,386 B2 * 2/2011 Balonick ..... A47C 27/088 5/709
8,108,957 B2 * 2/2012 Richards ..... A61G 7/05715 5/600
8,156,589 B2 * 4/2012 Liu ..... A47C 27/10 5/655.3
8,176,588 B2 * 5/2012 Lin ..... A47C 27/082 190/2
8,192,381 B2 * 6/2012 Nozzarella ..... A61H 9/0078 601/152
8,257,288 B2 * 9/2012 Hansen ..... A61H 31/004 601/151
8,640,285 B2 * 2/2014 Heimbrock ..... A61G 7/005 5/610
8,739,338 B2 * 6/2014 Rickman ..... A61G 7/05769 137/625.17
8,745,784 B2 * 6/2014 Cole ..... A47C 27/083 5/423
8,826,473 B2 * 9/2014 Flanagan ..... A61G 7/05784 5/600
8,852,131 B2 * 10/2014 Siegner ..... A61G 7/05776 5/698
8,914,928 B2 * 12/2014 Huyser ..... A61G 7/05776 5/713

(56) References Cited

U.S. PATENT DOCUMENTS 9,228,885 B2 * 1/2016 Zerhusen ..... A47C 27/18
9,295,336 B2 * 3/2016 Driscoll, Jr. ..... A47C 27/082
9,486,816 B2 * 11/2016 Gerdes ..... B05B 1/12
9,549,869 B2 * 1/2017 DeVlieger ..... A61H 23/02
9,572,433 B2 * 2/2017 Lachenbruch ..... A61F 7/0053
9,657,861 B2 * 5/2017 Enomoto ..... F16K 11/22
9,687,413 B2 * 6/2017 Shaltis ..... A61H 9/0078
9,713,567 B2 * 7/2017 Guantera ..... A61H 23/04
9,801,767 B2 * 10/2017 Gowda ..... A61G 7/05776
10,292,881 B2 * 5/2019 Ribble ..... A61G 7/015
10,548,788 B2 * 2/2020 Lachenbruch ..... A61G 13/0054
2002/0059679 A1 * 5/2002 Weismiller ..... A61G 7/0528 5/610
2002/0073489 A1 * 6/2002 Totton ..... A61G 7/05769 5/713
2002/0104535 A1 * 8/2002 Biondo ..... A61G 5/006 128/204.21
2002/0111571 A1 * 8/2002 Warwick ..... A61H 23/04 601/44
2004/0135112 A1 * 7/2004 Greeb ..... E21B 34/02 251/214
2005/0235988 A1 * 10/2005 Hansen ..... A61H 9/0078 128/200.24
2007/0120084 A1 * 5/2007 Stumbo ..... F16J 15/004 251/214
2007/0246678 A1 * 10/2007 Michaels ..... F16K 11/087 251/304
2007/0266499 A1 * 11/2007 O'Keefe ..... A61G 7/015 5/713
2008/0000477 A1 * 1/2008 Huster ..... A61B 34/25 128/204.23
2008/0105842 A1 * 5/2008 Webster ..... F16K 11/074 251/180
2008/0127423 A1 * 6/2008 Gammons ..... A47C 27/082 5/713
2008/0172789 A1 * 7/2008 Elliot ..... G06F 19/00 5/616
2008/0214888 A1 * 9/2008 Ben Shalom ..... A61M 1/106 600/17
2008/0263776 A1 * 10/2008 O'Reagan ..... A61G 7/05746 5/714
2008/0272591 A1 * 11/2008 Leber ..... B05B 15/65 285/261
2009/0079281 A1 * 3/2009 Best ..... H02K 5/225 310/71
2009/0090415 A1 * 4/2009 Harris ..... F16K 27/003 137/7
2009/0093912 A1 * 4/2009 Wilker, Jr. ..... A61G 7/05776 700/282
2009/0299239 A1 * 12/2009 Meyer ..... A61H 11/00 601/149
2010/0043143 A1 2/2010 O'Reagan et al.
2010/0059701 A1 * 3/2010 McLean ..... F16K 11/0743 251/304
2010/0180384 A1 * 7/2010 Balonick ..... A47C 27/10 5/709
2010/0281959 A1 * 11/2010 Berndt ..... F16K 11/074 73/61.56
2010/0282190 A1 * 11/2010 Stoermer ..... F16K 11/0856 123/41.08
2011/0131725 A1 * 6/2011 Stroh ..... A61G 7/05776 5/600
2011/0173758 A1 * 7/2011 Fontaine ..... A61G 7/05715 5/709
2011/0225740 A1 * 9/2011 Huyser ..... A61G 7/05776 5/713
2011/0253223 A1 * 10/2011 Sharron ..... F16K 11/074 137/1
2011/0289691 A1 * 12/2011 Lafleche ..... A61G 7/05776 5/710
2011/0306910 A1 * 12/2011 Siegner ..... A61F 13/046 602/13
2012/0180890 A1 * 7/2012 Kojima ..... F16K 11/074 137/625.46
2013/0048089 A1 * 2/2013 Adey ..... G01N 35/10 137/1
2013/0074268 A1 * 3/2013 Receveur ..... A61G 7/05 5/630
2013/0133511 A1 * 5/2013 Ishida ..... F03C 1/053 91/172
2013/0145558 A1 * 6/2013 Bhai ..... A61G 7/015 5/710
2014/0216254 A1 * 8/2014 Tammera ..... B01D 53/0462 95/114
2014/0223665 A1 * 8/2014 Chapin ..... A47C 27/10 5/710
2014/0237726 A1 * 8/2014 Gibson ..... A61G 7/015 5/691
2014/0245773 A1 * 9/2014 Sherbeck ..... F16K 11/0833 62/324.6
2014/0259428 A1 * 9/2014 O'Keefe ..... A61H 9/0071 5/689
2015/0059100 A1 * 3/2015 Brubaker ..... A61G 7/05776 5/710
2015/0101693 A1 * 4/2015 Enomoto ..... F16K 11/22 137/597
2015/0157521 A1 * 6/2015 Williams ..... A47C 27/088 5/81.1 R
2015/0164720 A1 * 6/2015 Gibson ..... A61G 7/001 5/83.1
2015/0182400 A1 * 7/2015 Meyer ..... A61G 7/018 5/710
2015/0257952 A1 * 9/2015 Zerhusen ..... A61G 7/001 340/12.5
2015/0335507 A1 * 11/2015 Emmons ..... G16H 20/00 5/615
2016/0022520 A1 * 1/2016 Streeter ..... F16K 11/076 5/655.3
2016/0157631 A1 6/2016 Milnes et al.
2016/0348670 A1 * 12/2016 Sakohira ..... F04B 49/22
2017/0181921 A1 * 6/2017 Wren ..... A61H 11/00
2018/0085541 A1 3/2018 Ye et al.
2018/0333325 A1 * 11/2018 Inoue ..... A61H 9/0078
2019/0142686 A1 * 5/2019 Lee ..... A61H 23/006 601/44
2020/0041011 A1 * 2/2020 Melhus ..... F03B 17/005

* cited by examiner

MATTRESS OVERLAY CONTROL SYSTEM WITH ROTARY VALVES AND GRAPHICAL USER INTERFACE FOR PERCUSSION AND VIBRATION, TURN ASSIST AND MICROCLIMATE MANAGEMENT

The present application claims the benefit, under 35 U.S.C. § 119(e), of U.S. Provisional Application No. 62/483,636, filed Apr. 10, 2017, which is hereby incorporated by reference herein in its entirety.

BACKGROUND

The present disclosure relates to a mattress overlay used in connection with a mattress of a patient support apparatus and particularly, to a control unit that controls pneumatic functions of the mattress overlay. More particularly, the present disclosure relates to internal components of the control unit for the mattress overlay which have multiple settings for inflating and deflating portions of the mattress overlay.

SUMMARY

An apparatus, system, or method may comprise one or more of the features recited in the appended claims and/or the following features which, alone or in any combination, may comprise patentable subject matter:

A mattress overlay apparatus for use with a mattress may include an overlay configured for placement atop the mattress that may have a plurality of inflatable bladders. The plurality of inflatable bladders may be pneumatically coupled to a blower. A first and second rotary plate valves may be pneumatically coupled to the plurality of bladders and the blower. The rotary plate valves may be arranged in series between the plurality of bladders and the blower.

In some embodiments, the blower has an inlet and an outlet. The first rotary valve may include a first rotary plate that may be movable between a first position and a second position. When the first rotary plate is in the first position, the inlet of the blower may be coupled to atmosphere and the outlet of blower may be coupled to the second rotary plate valve so that positive pressure produced at the outlet of the blower may be applied to the second rotary plate valve. When the first rotary plate is in the second position, the outlet of the blower may be coupled to atmosphere and the inlet of the blower may be coupled to the second rotary plate valve so that negative pressure produced at the inlet of the blower may be applied to the second rotary plate valve.

In some embodiments, the second rotary plate valve may include a second rotary plate that may be movable between first, second, third, and fourth positions. The plurality of inflatable bladders may include at least one percussion and vibration (P&V) bladder, a left turn bladder, a right turn bladder, and a microclimate management (MCM) envelope. When the second rotary plate is in the first position and the first rotary plate is in the first position, the blower may be operable to inflate the at least one P&V bladder. When the second rotary plate is in the second position and the first rotary plate is in the first position, the blower may be operable to inflate the left turn bladder. When the second rotary plate is in the third position and the first rotary plate is in the first position, the blower may be operable to inflate the right turn bladder. When the second rotary plate is in the fourth position and the first rotary plate is in the first position, the blower may be operable to move air through the MCM envelope.

In some embodiments, when the second rotary plate is in the first position and the first rotary plate is in the second position, the blower may be operable to deflate the at least one P&V bladder. When the second rotary plate is in the second position and the first rotary plate is in the second position, the blower may be operable to deflate the left turn bladder. When the second rotary plate is in the third position and the first rotary plate is in the second position, the blower may be operable to deflate the right turn bladder.

In some embodiments, the plurality of bladders may include at least one percussion and vibration (P&V) bladder. The first rotary plate valve may have a first rotary plate and the second rotary plate valve may have a second rotary plate. When the second rotary plate of the second rotary plate valve is in a P&V position, the first rotary plate may be oscillated between a first position in which positive pressure at an outlet of the blower may be applied to the at least one P&V bladder to inflate the at least one P&V bladder and a second position in which negative pressure at an inlet of the blower may be applied to the at least one P&V bladder to deflate the at least one P&V bladder.

In some embodiments, a frequency at which the first rotary plate oscillates between the first and second positions may be from about 5 Hertz to about 20 Hertz. The mattress overlay apparatus may include a conduit through which the second rotary plate valve pneumatically communicates with the at least one P&V bladder. The conduit may include a tube made of cloth-like, flexible material and a quantity of 3-dimensional (3D) engineered material within the tube that may prevent the tube from collapsing.

The mattress overlay apparatus may include a housing in which the blower, the first rotary plate valve, and the second rotary plate valve may be contained. The second rotary plate valve may have a set of four output ports accessible at an exterior of the housing. The mattress overlay apparatus may include a hose assembly that may have four hoses and a hose adapter that may attach to the housing so that the four hoses may substantially simultaneously couple to the set of four output ports of the second rotary plate valve. In some embodiments, the plurality of inflatable bladders may include at least one percussion and vibration (P&V) bladder that may be pneumatically coupled to a first hose of the set of four hoses, a left turn bladder that may be pneumatically coupled to a second hose of the set of four hoses, a right turn bladder that may be pneumatically coupled to a third hose of the set of four hoses, and a microclimate management (MCM) envelope that may be pneumatically coupled to a fourth hose of the set of four hoses.

In some embodiments, the first hose may be strengthened with a coil of wire due to the blower being operated to inflate the at least one P&V bladder at a higher pressure than may be used to inflate the left turn bladder, the right turn bladder, and the MCM envelope. For example, the pressure applied by the blower to P&V bladders via the first hose may be about 70 to about 80 $cmH_2O$ at a high intensity setting. The pressure applied by the blower to the left and right turn bladders via the second and third hoses, respectively, may be about 30 to about 40 $cmH_2O$. The pressure applied by the blower to the MCM envelope via the fourth hose may be about 20 to about 30 $cmH_2O$.

A graphical user interface (GUI) may be accessible on the housing in some embodiment. The graphical user interface may display a first touch button that may be selected to activate a percussion and vibration (P&V) function of the overlay, a second touch button that may be selected to activate a left turn assist function of the overlay, a third touch button that may be selected to activate a right turn assist function of the overlay, and a fourth touch button that may be selected to activate a microclimate management (MCM) function of the overlay.

The GUI may display an off button that may be selected to turn off whichever of the P&V function, left turn assist function, right turn assist function, and MCM function is being operated. Alternatively or additionally, sequential presses of each of the first, second, third, and fourth buttons turns the associated function on, then off, then on, then off, etc. Operation of each of the P&V function, left turn assist function, right turn assist function, and MCM function may be mutually exclusive such that only one of the P&V function, left turn assist function, right turn assist function, and MCM function may be able to be operated at any given time.

In some embodiments, the first rotary plate valve may have a first rotary plate that may be moved by a first stepper motor and the second rotary plate valve may have a second rotary plate that may be moved by a second stepper motor. A first axis of rotation of the first rotary plate may be substantially perpendicular to a second axis of rotation of the second rotary plate, but other arrangements in which the first and second axes are not substantially perpendicular are within the scope of the present disclosure.

The second rotary plate valve may have a plurality of outlet ports and a rotary plate with a hole that may be selectively alignable with each outlet port of the plurality of outlet ports. The second rotary plate valve may have a plurality of cup seals that may be spring biased against the rotary plate. The rotary plate may include a bar that may extend across the hole thereby to separate the hole into two hole portions. The bar may prevent seal herniation of the cup seals as the rotary plate is rotated. Each cup seal of the plurality of cup seals may be aligned with a respective outlet port of the plurality of outlet ports. Optionally, at least a portion of the bar extending across the hole may be curved.

In some embodiments, the mattress overlay apparatus may further include straps that may be coupled to the overlay and sized to extend under the mattress to retain the overlay on the mattress. The mattress overlay apparatus may further include a plurality of hoses that may extend between the second rotary plate valve and the plurality of bladders and further may include a plurality of hose straps that may retain portions of the plurality of hoses along at least one side or a least one end of the mattress or both. Each hose strap of the plurality of hose straps may be constructed so as to define multiple loops, for example, though which respective hoses of the plurality of hoses may be routed. If desired, the overlay may include side and end flaps that may cover the hose straps and the portions of the plurality of hoses retained by the hose straps.

In some embodiments, the plurality of inflatable bladders may include a set of percussion and vibration (P&V) bladders that may be formed by coupling together a first layer of material of the overlay and a second layer of material of the overlay such that the P&V bladders may extend laterally across a majority of a width of the overlay and such that conduits through which air may be delivered to the P&V bladders may be defined between the first and second layers along opposite longitudinal sides of the overlay. Alternatively, the conduits may all be situated along a same longitudinal side of the overlay.

In some contemplated embodiments, the mattress overlay apparatus may further include a vital signs sensor that may be integrated into the overlay. Such a vital signs sensor may be configured to measure heart rate and respiration rate. The vital signs sensor may include a capacitive sensor, for example. The vital signs sensor may be configured to sense patient presence on the overlay and/or patient absence from the overlay.

The plurality of inflatable bladders may include at least one percussion and vibration (P&V) bladder, a left turn bladder, a right turn bladder, and a microclimate management (MCM) envelope. The blower may be operated in an open loop manner at a respective set speed when inflating the at least one P&V bladder and pressurizing the MCM envelope. The blower may be operated in a closed loop manner when inflating the left and right turn bladders. In this regard, the mattress overlay apparatus may further include at least one pressure sensor that may sense a pressure that may be output to the left and right turn bladders. The pressure sensed by the pressure sensor may be used in connection with the closed loop control of the blower. Patient weight and desired time to complete inflation of the left and right turn bladders also may be used in connection with the closed loop control of the blower. The set speed of operation of the blower to inflate the at least one P&V bladder may be different than the set speed of operation of the blower to pressurize the MCM envelope.

The plurality of inflatable bladders may include at least one percussion and vibration (P&V) bladder and the overlay may include a pocket beneath the at least one P&V bladder for insertion of an auxiliary support surface when the at least one P&V bladder is in use to enhance rigidity of the overlay beneath the at least one P&V bladder. The auxiliary support surface may include a separately inflated intermediate bladder, for example. Alternatively or additionally, the auxiliary support surface may include a substantially rigid plate. The pocket may be configured to receive a chest X-ray plate therein. In some embodiments, the pocket may be accessible through an opening at a side of the overlay. If desired, a zipper may be coupled to the overlay and may be configured to open and close the opening.

In some embodiments, an upper layer of the overlay may include foam. The foam may be situated within the MCM envelope. Thus, the foam may have sufficient porosity for airflow therethough. Alternatively or additionally, an upper layer of the overlay may include a microclimate management (MCM) envelope that may contain 3-dimensional (3D) engineered material therein.

According to another aspect of the present disclosure, a mattress overlay apparatus for use with a mattress may be provided and may include an overlay that may be configured for placement atop the mattress. The overlay may have at least one percussion and vibration (P&V) bladder, a left turn bladder, a right turn bladder, and a microclimate management (MCM) envelope. An air source may be included in the apparatus and may have an inlet and an outlet. A two-position valve may be coupled to the inlet and the outlet of the air source. The two-position valve may have a first position and a second position. A four-position valve may be coupled to the two-position valve and may have first, second, third, and fourth positions. The at least one P&V bladder may be inflated by air from the air source when the two-position valve is in its first position and the four-position valve is in its first position. The at least one P&V bladder may be deflated by the air source when the two-position valve is in its second position and the four-position valve is in its first position. The left turn bladder may be inflated by air from the air source when the two-position valve is in its first position and the four-position valve is in its second position. The left turn bladder may be deflated by the air source when the two-position valve is in its second position and the four-position valve is in its second position.

The right turn bladder may be inflated by air from the air source when the two-position valve is in its first position and the four-position valve is in its third position. The right turn bladder may be deflated by the air source when the two-position valve is in its second position and the four-position valve is in its third position. The MCM envelope may be pressurized by air from the air source when the two-position valve is in its first position and the four-position valve is in its fourth position.

In some embodiments, the two-position valve may include a first rotary plate and the four-position valve may include a second rotary plate. The first rotary plate may have four air passage holes and the second rotary plate may have one air passage hole with a bar extending thereacross to define two air passage hole portions. The four-position valve may have a plurality of cup seals that may be spring biased against the second rotary plate. The bar may prevent seal herniation of the cup seals as the second rotary plate is rotated. Optionally, at least a portion of the bar may be curved. Alternatively or additionally, at least a portion of the bar may be substantially straight.

In some embodiments, a first axis of rotation of the first rotary plate may be substantially perpendicular to a second axis of rotation of the second rotary plate. The two-position valve may include a first stepper motor that may operate to rotate the first rotary plate and the four-position valve may include a second stepper motor that may operate to rotate the second rotary plate.

Inflation of each of the at least one P&V bladder, the left turn assist bladder, and the right turn assist bladder and the pressurization of the MCM envelope may be mutually exclusive such that only one of a P&V function, a right turn assist function, a left turn assist function, and an MCM function may be able to be operated at any given time. The air source may include a blower, for example. Alternatively or additionally, the air source may include a pump, a compressor, a pressurized reservoir, a gas supply system of a health care facility, and so forth.

According to a further aspect of the present disclosure, a valve apparatus may include a valve body, a rotary plate that may be coupled to the valve body for rotation, and a seal that may be in contact with the rotary plate. The rotary plate may have a hole formed therethough and an anti-herniation appendage may be situated in the hole. The anti-herniation appendage may prevent herniation of the seal as the rotary plate rotates the hole across at least a portion of the seal.

In some embodiments, the seal may comprise an annular seal. If desired, a spring may be arranged to bias the annular seal against the rotary plate. For example, the spring may include a coil spring that may be compressed between the annular seal and a portion of the valve body. Optionally, the annular seal may include a cup seal.

In some embodiments, the anti-herniation appendage may include a bar that may extend across the hole to define two hole portions. At least a portion of the bar is curved in some embodiments. Alternatively or additionally, at least a portion of the bar may be substantially straight. A stepper motor may be coupled to the valve body and may be operable to rotate the rotary plate. The valve body may include a main body that may having a cylindrical chamber in which the rotary plate may be situated and a cover that may attach to the main body. Optionally, the cover may have a cylindrical projection that may extend into the cylindrical chamber of the main body.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

Figure 1:
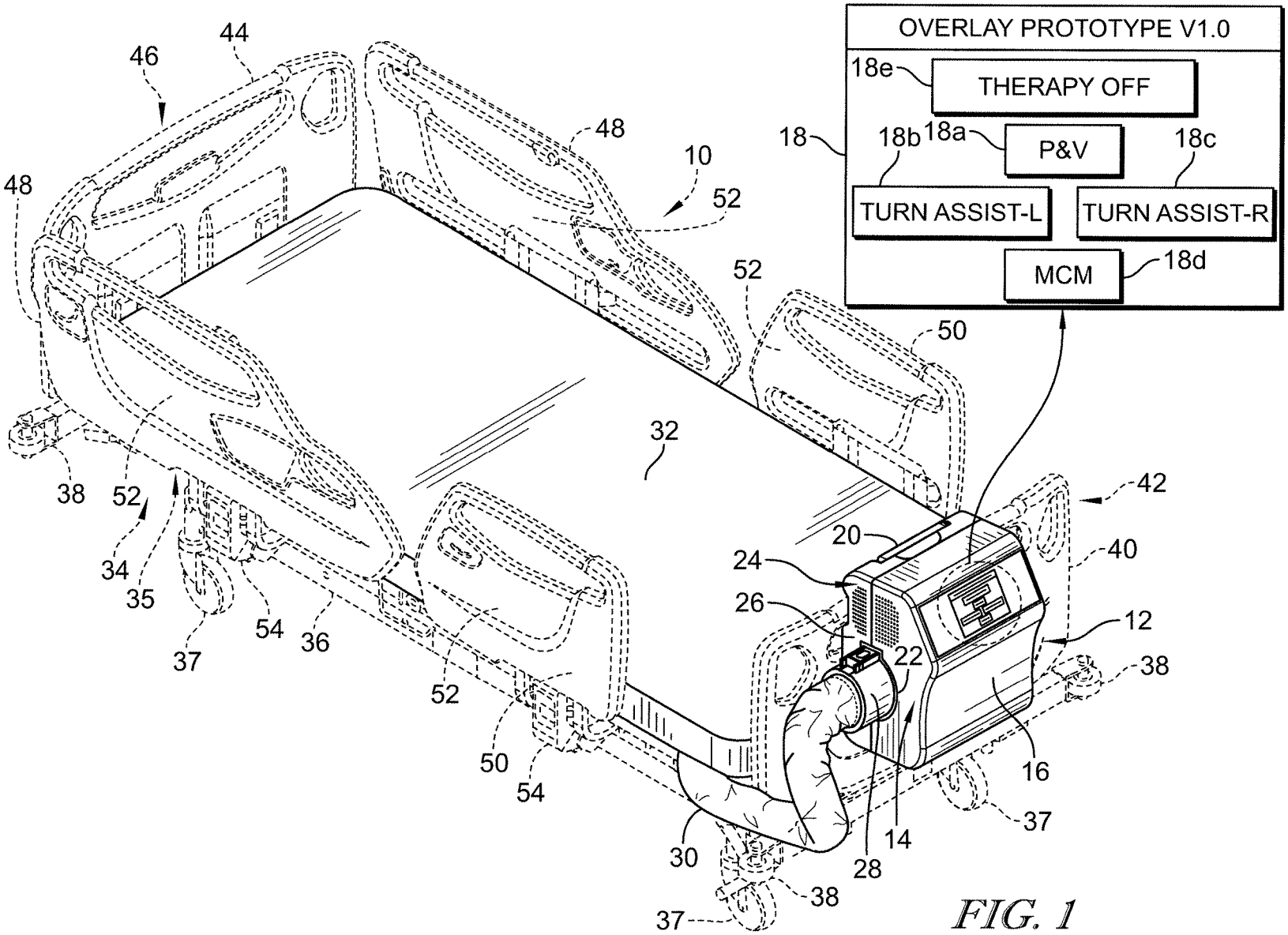
FIG. 1 is a perspective view of a hospital bed including a mattress and a mattress overlay having a control unit coupled to a footboard of the hospital bed.
Figure 2:
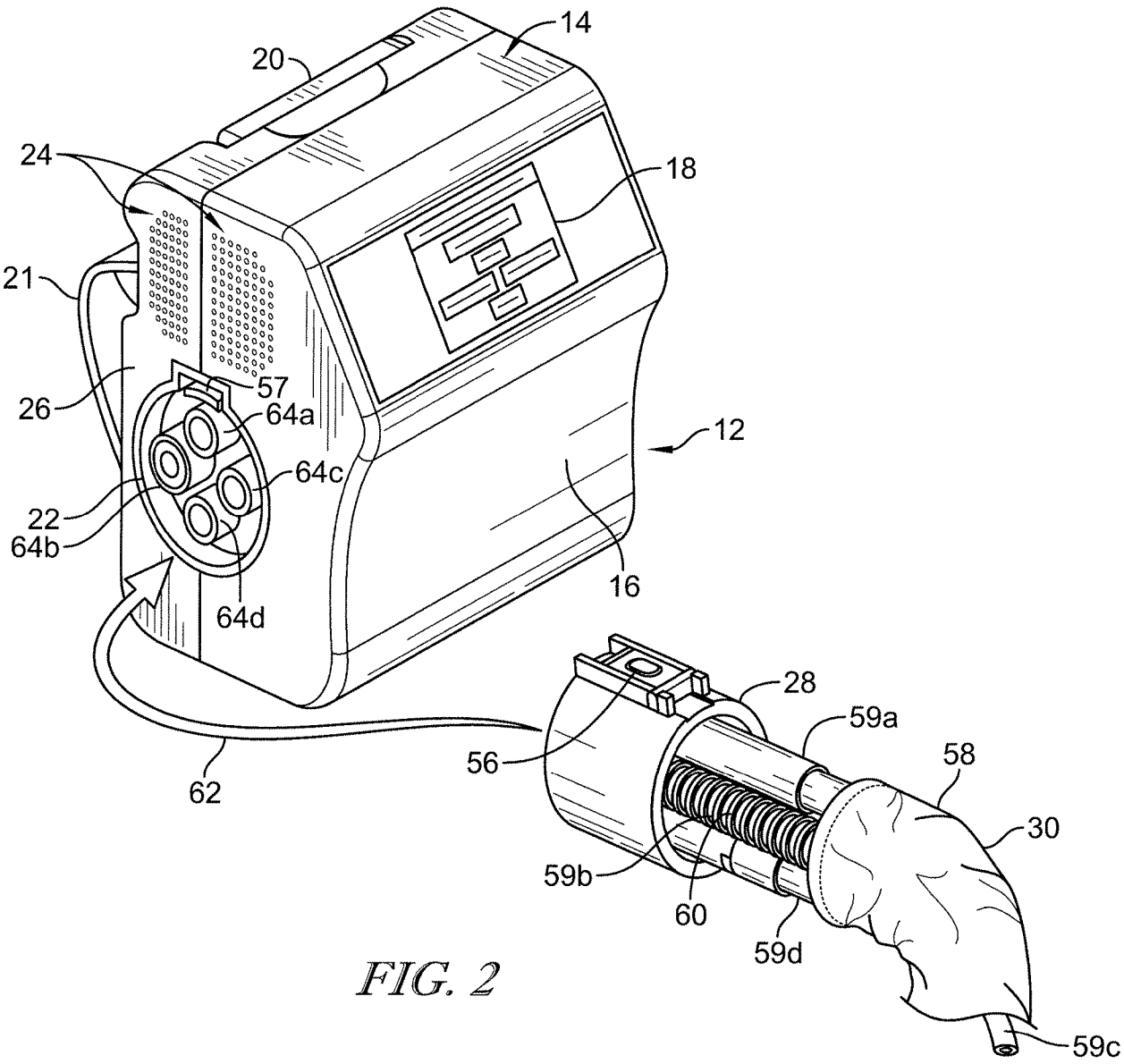
FIG. 2 is a perspective view of the control unit of FIG. 1 showing the control unit having a housing, a graphical user interface at a front of the housing, and a hose port at a side of the housing for connection to of a set of hoses that lead to a plurality of inflatable bladders of the mattress overlay.
Figure 3:
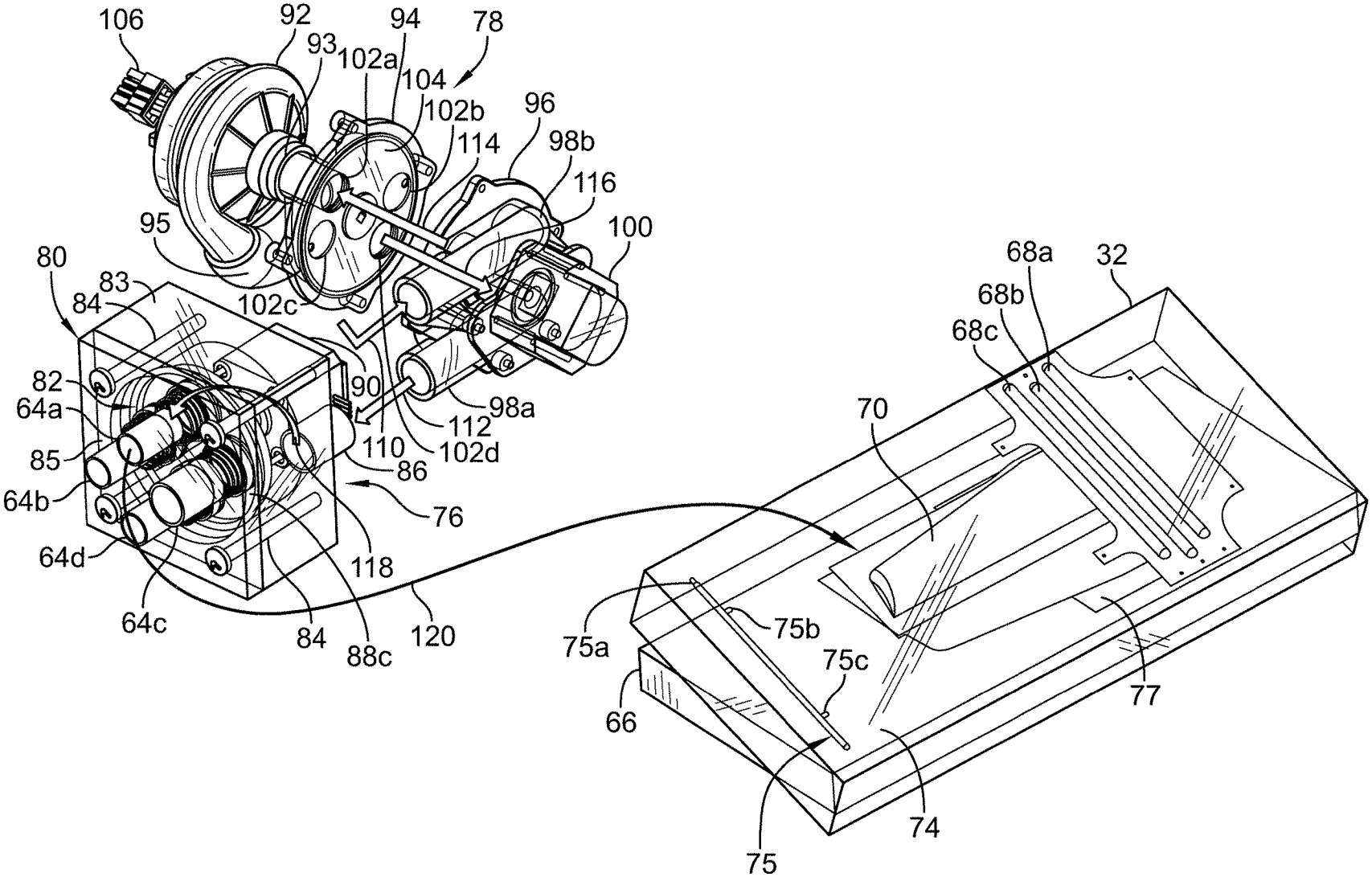
FIG. 3 is a perspective view of some of the internal components of the control unit of FIG. 2 showing a blower, a first rotary plate valve and manifold assembly situated between the blower and a stepper motor, and a second rotary plate valve arranged for coupling to the manifold assembly, and showing a series of arrows that indicate a flow of air from the atmosphere through the blower, the first rotary plate valve, the manifold assembly, and the second rotary plate valve to the mattress overlay to inflate a right turn bladder of the mattress overlay.

A patient support apparatus, such as illustrative hospital bed 10, includes a patient support structure such as a frame 34 that supports a mattress 66 covered by a mattress overlay 32 as shown in FIG. 1 (mattress 66 is shown in FIG. 3). A control unit 12 operates to provide mattress overlay 32 with a plurality of functions such as percussion & vibration (P&V) therapy using P&V bladders 68*a*, 68*b*, 68*c*, turn assist using turn assist bladders 70, 72, and microclimate management (MCM) using an MCM envelope 74 as will be further described below. FIGS. 1-16 show either an embodiment or an embodiment of a component of one possible bed 10 having the capability to perform the plurality of functions. However, this disclosure is applicable to other types of patient support apparatuses, including other types of beds, surgical tables, examination tables, stretchers, and the like.

Illustrative hospital bed 10 has a frame 34 which includes an upper frame assembly 35, a base 36, and a lift system 39 coupling upper frame assembly 35 to base 36 as shown in FIG. 1. Lift system 39 is operable to raise, lower, and tilt upper frame assembly 35 relative to base 36. Bed 10 has a foot end 42 and a head end 46. Hospital bed 10 further includes a footboard 40 at the foot end 42 and a headboard 44 at the head end 46. Footboard 40 and headboard 44 are coupled to the upper frame assembly 35 in the illustrative embodiment. Base 36 includes wheels or casters 37 that roll along a floor (not shown) as bed 10 is moved from one location to another. Bumpers 38 are coupled to the upper frame assembly 35 at the corner regions of bed 10.

Figure 11:
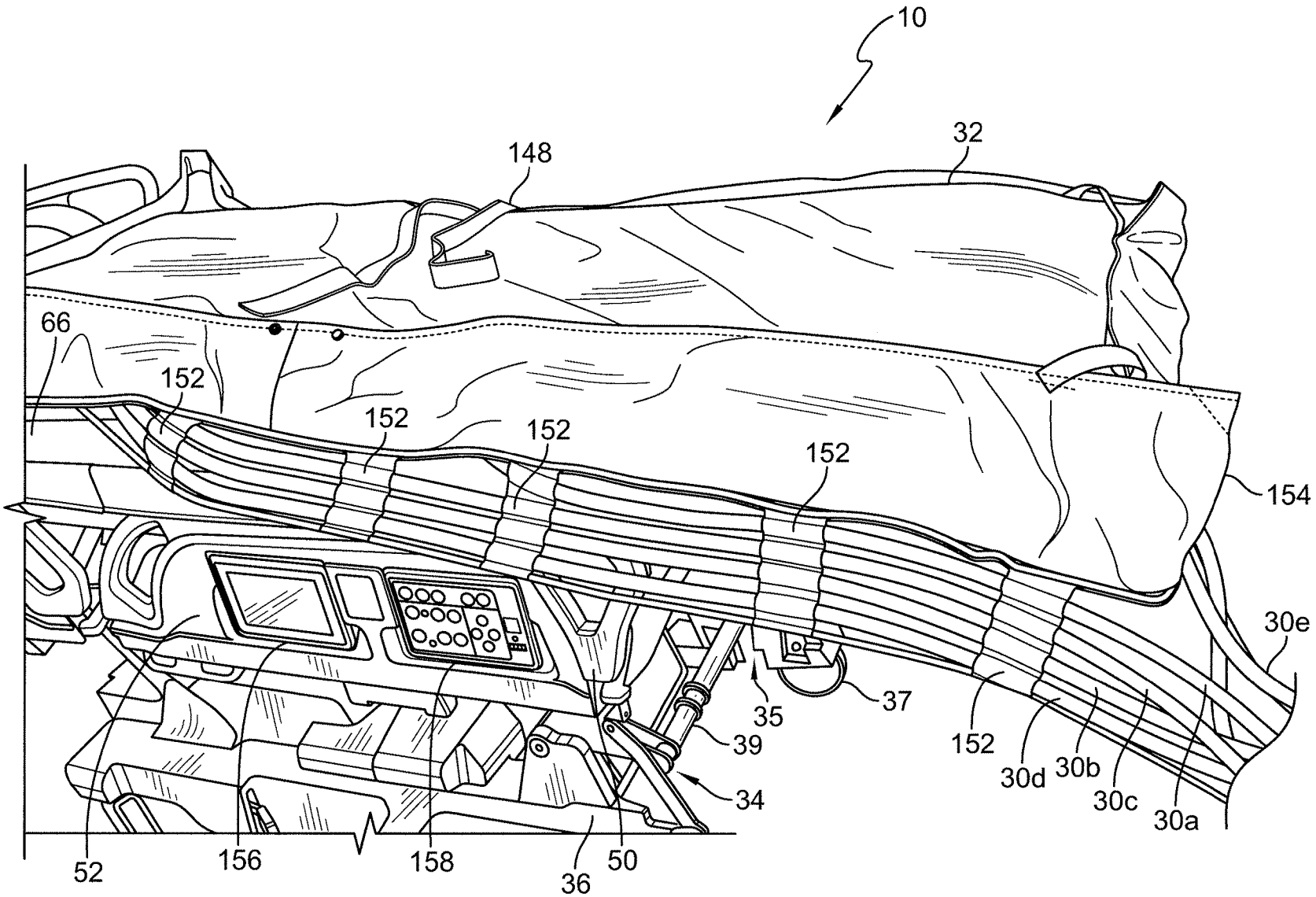
FIG. 11 is a perspective view of a side of the hospital bed with a flaps of the mattress overlay pulled up to reveal the plurality of hoses coupled to the side of the mattress overlay and a side rail of the bed including a graphical user interface.

Illustrative hospital bed 10 has four siderail assemblies coupled to upper frame assembly 35 as shown in FIG. 1. The four siderail assemblies include a pair of head siderail assemblies 48 (sometimes referred to as head rails) and a pair of foot siderail assemblies 50 (sometimes referred to as foot rails). Each of the siderail assemblies 48 and 50 is movable between a raised position, as shown in FIG. 1, and a lowered position (as shown in FIG. 11). Siderail assemblies 48, 50 are sometimes referred to herein as siderails 48, 50. Each siderail 48, 50 includes a barrier panel 52 and a linkage 54. Each linkage 54 is coupled to the upper frame assembly 35 and is configured to guide the barrier panel 52 during movement of siderails 48, 50 between the respective raised and lowered positions. Barrier panel 52 is maintained by the linkage 54 in a substantially vertical orientation during movement of siderails 48, 50 between the respective raised and lowered positions.

Referring now to FIGS. 1 and 2, control unit 12 includes a housing 14, a graphical user interface 18, a handle 20, a hose port 22, and a vent 24. The housing 14 includes a front portion 16 and a rear portion 26 that attach together to enclose internal components of the control unit 12. The graphical user interface 18 comprises a touchscreen (referred to as touchscreen 18) that is illustratively enlarged in FIG. 1 to show a plurality of touch buttons 18*a*-18*e* that a user selects to control the manner in which the control unit 12 operates. Each button 18*a*-18*e* corresponds to a particular therapy that overlay 32 is able to deliver to a patient under the control of control unit 12. In some embodiments, one press of each of the buttons 18*a*-18*d* initiates the use of the respective function and another, subsequent press of the respective button 18*a*-18*d* stops the function. Thus, sequential presses of buttons 18*a*-18*d* turns on, then off, then on, then off, etc. the respective function. In the illustrative example, however, a therapy off button 18*e* is provided and is selected to stop the active function.

A P&V button 18*a* initiates a P&V therapy using the P&V bladders 68*a-c* (shown in FIG. 3). P&V therapy involves rapidly inflating and deflating bladders 68*a-c* to create pulsations at a high frequency to inhibit fluid from accumulating in a patient's lungs. A turn assist-L button 18*b* initiates inflation of turn assist bladder 70 (shown in an inflated state in FIG. 3) at the right of the mattress overlay 32. That is, during left turn assist, the right bladder 70 is inflated resulting in the patient's right side being raised relative to the patient's left side when the patient is lying in a supine position on mattress overlay 32. A turn assist-R button 18*c* initiates inflation of turn assist bladder 72 (shown in a deflated state in FIGS. 4-7) at the left of the mattress overlay 32. When bladder 72 is inflated its configuration is basically a mirror image about a longitudinal centerline of the overlay 32 of the configuration of the inflated bladder 70 shown in FIG. 3. Thus, during right turn assist, the left bladder 72 is inflated resulting in the patient's left side being raised relative to the patient's right side when the patient is lying in a supine position on mattress overlay 32. Turn assist, to the left or to the right, is employed by caregivers to assist in changing a patient's wound dressing or bed linens, for example.

An MCM button 18*d* initiates microclimate management via delivery of air to the microclimate management envelope 74 (shown in FIG. 3) through an MCM manifold 75. Envelope 74 extends from manifold 75 toward the head end of overlay 32. Manifold 75 is a tubular element that extends laterally across a foot end region of overlay 32. An inlet 75*a* is provided at one end of manifold (near the right side of overlay 32 in the illustrative example) and first and second outlets 75*b*, 75*c* extend substantially perpendicularly from manifold 75 by a small amount (e.g., 2 inches or less). Outlets 75*b*, 75*c* are pneumatically coupled to MCM envelope 74. Thus, pressurized air entering inlet 75*a* of manifold 75 exits manifold 75 through outlets 75*b*, 75*c* for receipt in MCM envelope 74.

In some embodiments, envelope 74 has openings to atmosphere at its head end such that the pressurized air flows beneath the upper layer of envelope 74 to the openings at the head end of envelope 74. Alternatively or additionally, the upper layer of envelope 74 has a multitude of small perforations (e.g., $1/8^{th}$ inch or less) through which air escapes from MCM envelope 74 and moves upwardly toward and around the patient. MCM is employed to reduce the moisture and/or heat between the patient and the upper surface of the overlay 32. MCM envelope 74 is sometimes referred to herein as MCM bladder 74 or just bladder 74 even though, in many contemplated embodiments, MCM bladder 74 permits air to escape to atmosphere therethrough.

In some embodiments, MCM envelope 74 comprises an upper layer of the overlay 32 and includes foam therein. Thus, the foam is situated between upper and lower sheets of material that define the MCM envelope 74. It should be appreciated that the foam has sufficient porosity for airflow therethough if the foam fills the MCM envelope 74. Alternatively or additionally, MCM envelope 74 that may contain a 3-dimensional (3D) engineered material therein and air from control unit 12 flows through the 3D engineered material.

In the illustrative embodiment, turn assist bladders 70, 72 have their respective long dimensions oriented generally parallel with a long dimension of overlay 32. Bladders 70, 72 each extend roughly from a normal-sized patient's head region to their knees when the patient is lying in a standard, supine position on overlay 32. P&V bladders 68*a-c* have their long dimensions oriented generally parallel with a lateral dimension of overlay 32. Thus, P&V bladders 68*a-c* are generally perpendicular to turn assist bladders 70, 72. Opposite ends of P&V bladders 68*a-c* extend beyond opposite outside edges of bladders 70, 72 such that each of bladders 68*a-c* extends nearly the full width of overlay 32. P&V bladders 68*a-c* extend over the top surface of bladders 70, 72 and are located so as to underlie the properly oriented supine patient's torso or chest region. Thus, head end portions of bladders 70, 72 extend beyond P&V bladder 68*a* toward the head end of overlay 32 and foot end portions of bladders 70, 72 extend beyond P&V bladder 68*c* toward the foot end of overlay 32 as shown best in FIG. 10. The MCM envelope 74 overlies both the turn assist bladders 70, 72 and the P&V bladders 68*a-c* in the illustrative example.

A hose assembly 30, shown in FIGS. 1 and 2, pneumatically couples control unit 12 to the mattress overlay 32 covering mattress 66 which is shown in FIG. 3. A hose adapter 28 at and end of hose assembly 30 attaches to a mating port 22 of control unit 12. The control unit 12 inflates and deflates the plurality of air bladders 68, 70, 72 (shown in FIG. 3) and directs air to the MCM envelope 74 (shown in FIG. 3) through respective hoses of the hose assembly 30. The control unit 12 is coupled to the footboard 40 in the illustrative example. In other embodiments, the control unit 12 may be coupled to another portion of the hospital bed 10.

Referring now to FIG. 2, control unit 12 is shown with the hose assembly 30 detached from housing 14 of control unit 12. Housing 14 includes a molded front housing shell or portion 16 and a molded rear housing shell or portion 26. Shells 16, 26 are coupled together to enclose the internal components of control unit 12. Graphical user interface 18 is accessible on the front of shell 16 to enter user inputs into control unit 12 and to see displayed information regarding the operation of control unit 12. Housing 14 includes a handle 20 at the top of shell 26. Handle 20 is gripped by a person to carry control unit 12. The rear portion 26 is configured with a coupler 21, such as a hook or strap or the like, that is used to couple control unit 12 to the hospital bed 10. A hose port 22 is provided at one side of housing 14 and is configured to receive hose assembly 30. Particularly, hose adapter 28 at the end of hose assembly 30 is configured to mate with hose port. 22. The hose port 22, in turn, includes a plurality of individual tube ports 64*a*-64*d* and a latch 57 that engages a portion of hose adapter 28 to secure hose assembly 30 to port 22. In the illustrative example, side wall portions of shells 16, 26 of housing 14 each have a number of vent holes 24 through which air enters and exits an interior region of housing 14.

In the illustrative example, hose assembly 30 includes a set of hoses 59*a*-59*d* and a sleeve 58 that covers the hoses 59*a*-59*d*. When hose adapter 28 is mechanically coupled to hose port 22 of housing 14, hoses 59*a*-59*d* of hose assembly 30 are pneumatically coupled to respective tube ports 64*a*-64*d*. Thus, tube ports 64*a*-64*d* align with the hoses 59*a*-59*d* of the hose assembly 30. A diagrammatic arrow 62 in FIG. 2 shows an illustrative direction of movement of adapter 28 of hose assembly 30 as it is inserted into the hose port 22. Hoses 59*a*-59*d* provide the conduits or passageways through which air is routed to and from the plurality of bladders 68*a-c*, 70, 72 and to the MCM envelope 74. The hose adapter 28 includes a button 56 that is pressed to decouple hose assembly 30 from hose port 22 of housing 14. The latch 57 of the hose port 22 engages the hose adapter 28 and provides a retaining force which is released when the button 56 is pressed. In some embodiments, an end of sleeve 58 is reinforced, such as with a plastic or metal ring, and is press fit into a bore of hose adapter 28 or otherwise coupled to hose adapter 28 such that adapter 28 overlaps the end of sleeve 58 which covers the hoses 59*a*-59*d*.

Hose 59*b* is pneumatically coupled to the P&V bladders 68*a-c*. In the illustrative example, a coiled wire 60 is included in hose 59*b* to strengthen hose 59*b* so that hose 59*b* is better able to withstand the higher pressures that control unit 12 applies to P&V bladders 68 as compared to the pressures applied by control unit 12 to bladders 70, 72 through hoses 59*a*, 59*c*, respectively, and to MCM envelope 74 through hose 59*d*. For example, in some embodiments, the pressure applied by control unit 12 to P&V bladders 68 via hose 59*b* is about 70 to about 80 $cmH_2O$ at a high intensity setting; the pressure applied by control unit 12 to bladders 70, 72 via hoses 59*a*, 58*c*, respectively, is about 30 to about 40 $cmH_2O$; and the pressure applied by control unit 12 to MCM envelope via hose 59*d* is about 20 to about 30 $cmH_2O$.

Based on the above description, it should be appreciated that each of tube ports 64*a*-64*d* is allocated to direct air from control unit 12 to P&V bladders 68*a-c*, to turn assist bladder 70, to turn assist bladder 72 or to the MCM envelope 74 via the associated hose 59*a*-59*d* of hose assembly 30. Thus, in the illustrative embodiment, port 64*a* is allocated to the P&V bladders 68*a-c*, port 64*b* is allocated to the right turn assist bladder 70, port 64*c* is allocated to to the left turn assist bladder 72, and port 64*d* is allocated to the MCM envelope 74. As will be discussed in further detail below, the illustrative control unit 12 is configured to control only one of the P&V, right turn, left turn, or MCM functions of mattress overlay 32 at a time.

Figure 4:
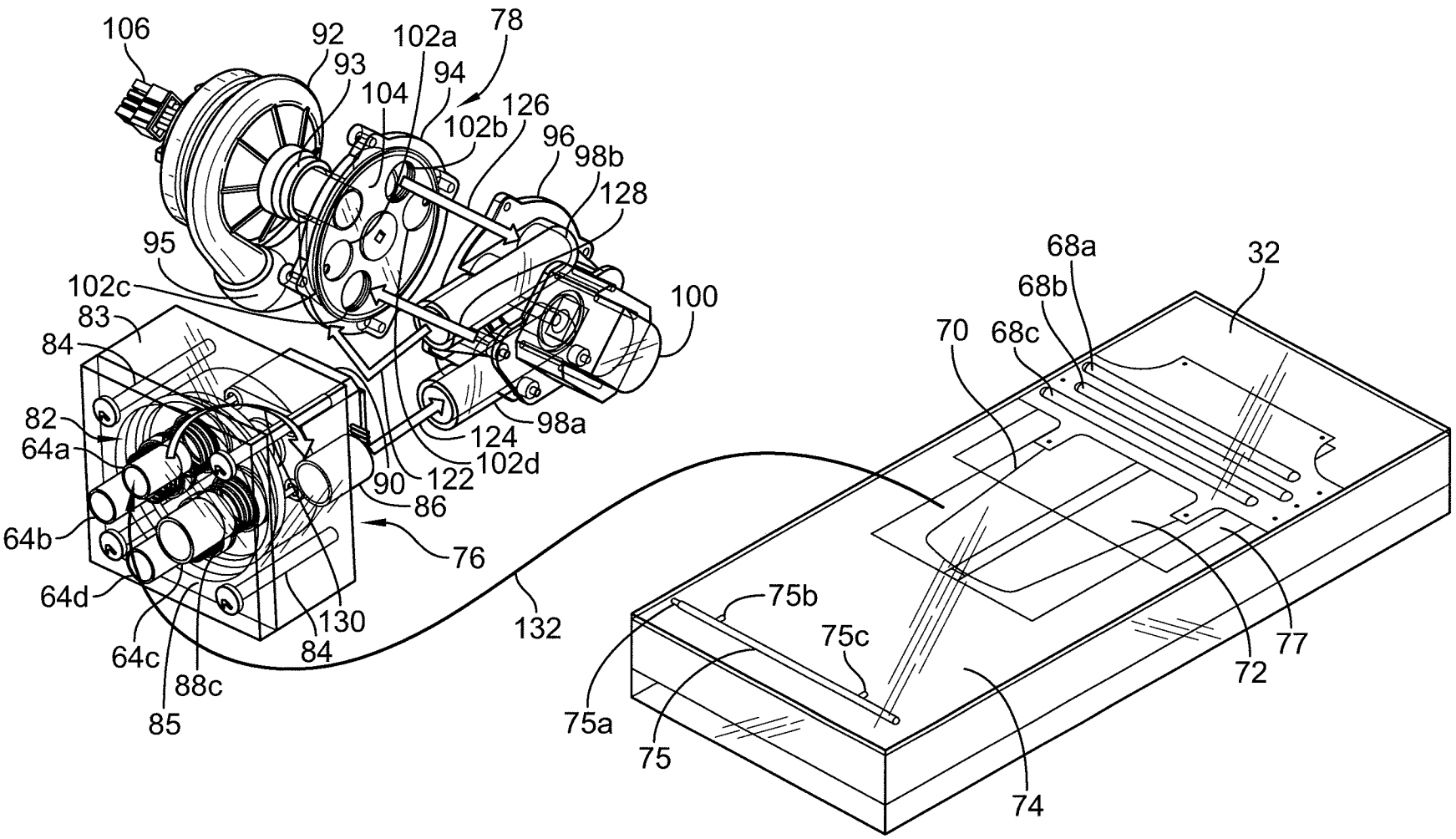
FIG. 4 is a perspective view similar to FIG. 3 showing a series of arrows that indicate a flow of air from the right turn bladder of the mattress overlay through the second rotary plate valve, the manifold assembly, the first rotary plate valve and the blower to atmosphere to deflate the right turn bladder.
Figure 5:
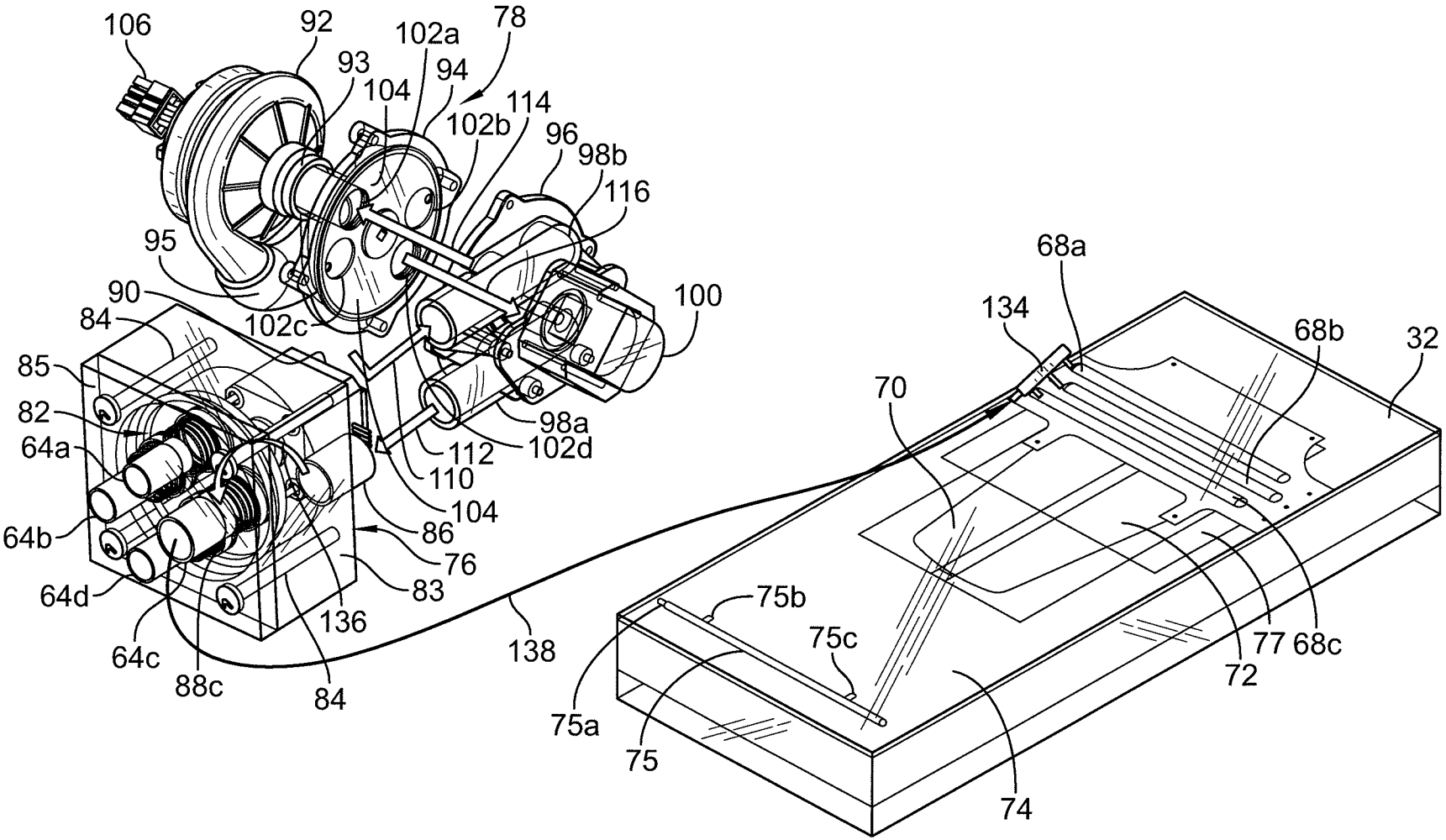
FIG. 5 is a perspective view similar to FIGS. 3 and 4, showing a series of arrows that indicate a flow of air from the atmosphere through the blower, the first rotary plate valve, the manifold assembly, and the second rotary plate valve to inflate percussion and vibration (P&V) bladders of the mattress overlay.
Figure 6:
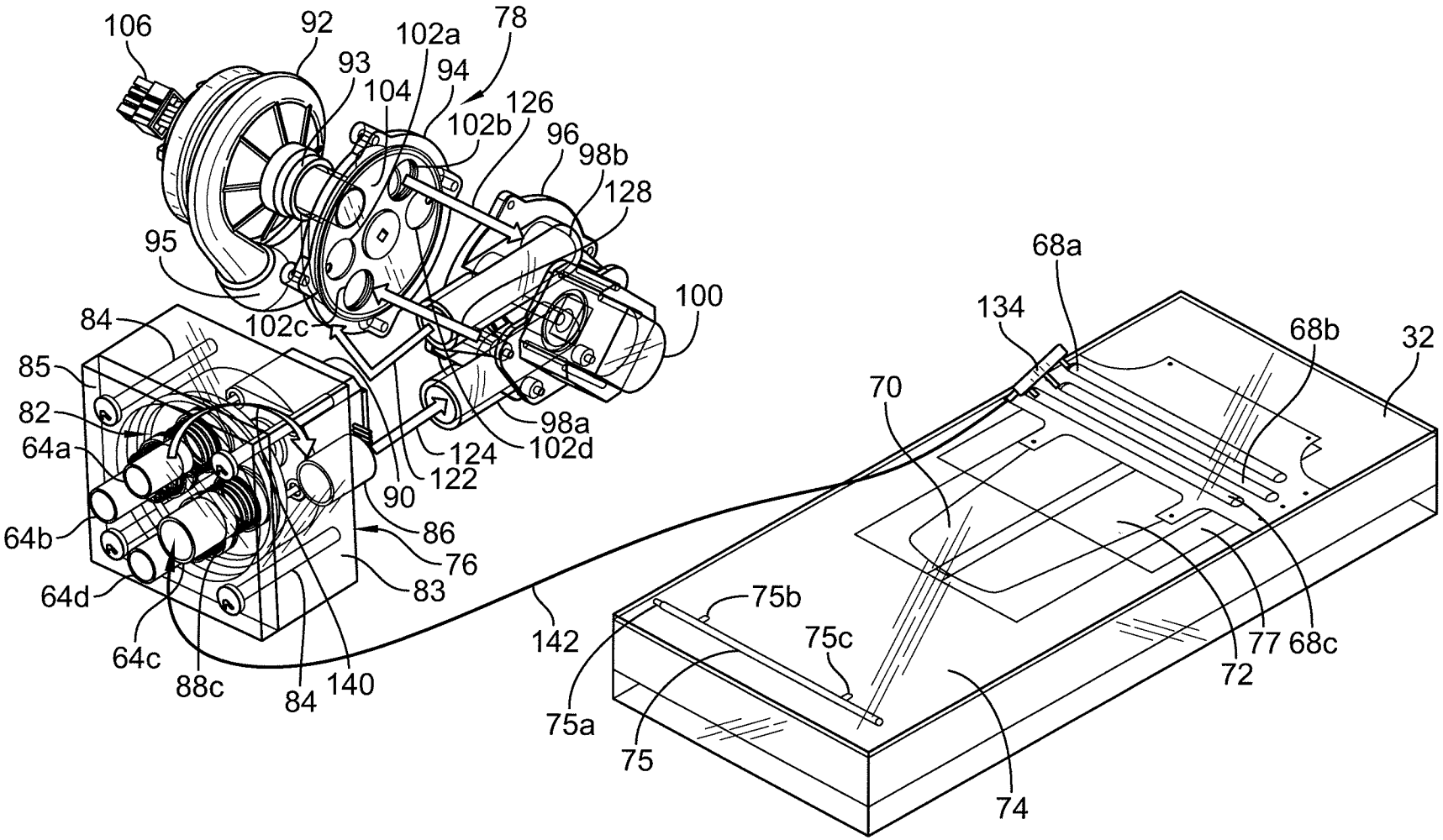
FIG. 6 is a perspective view similar to FIGS. 3-5, showing a series of arrows that indicate a flow of air from the P&V bladders of the mattress overlay through the second rotary plate valve, the manifold assembly, the first rotary plate valve, and the blower to atmosphere to deflate the P&V bladders.
Figure 7:
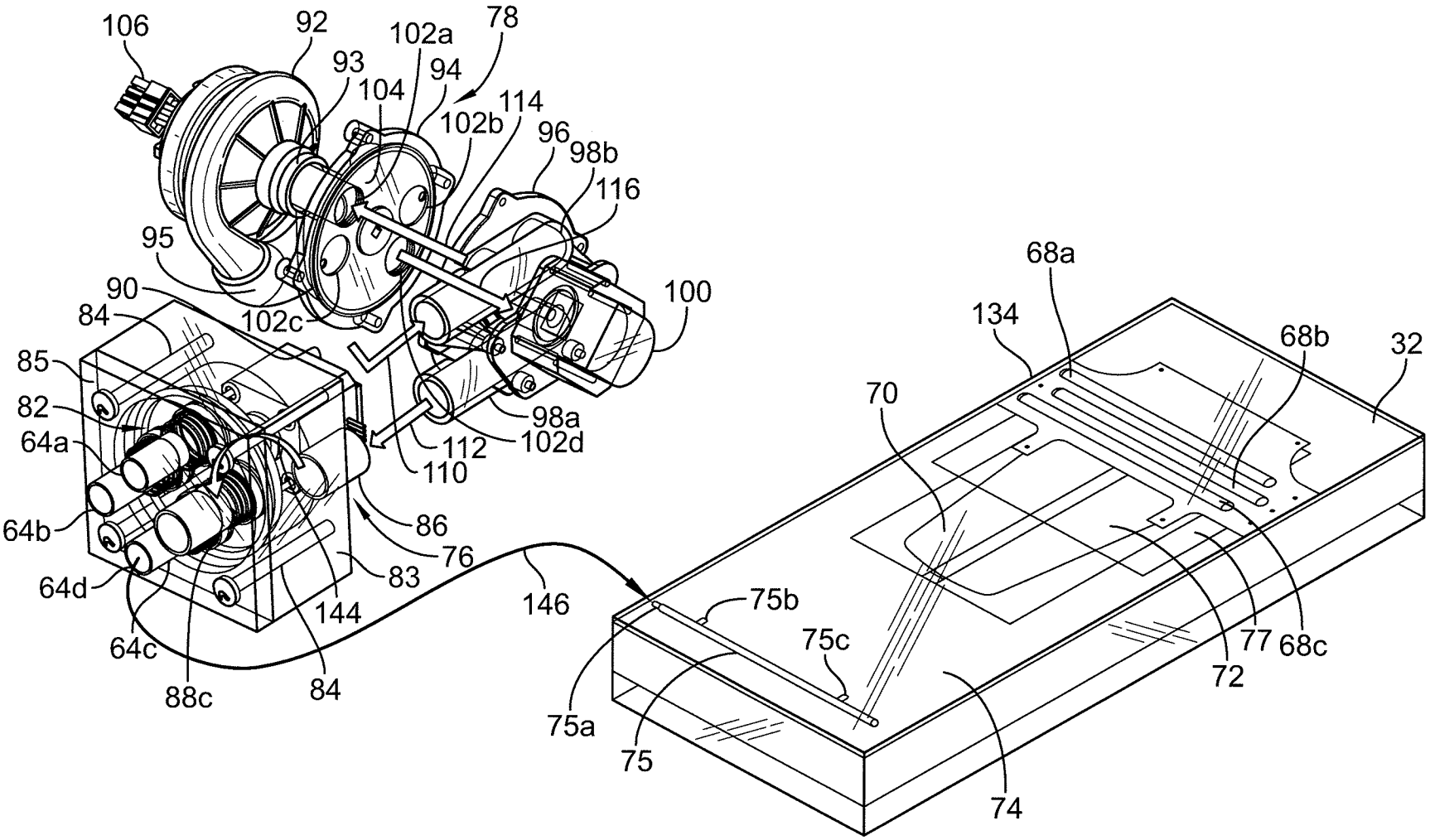
FIG. 7 is a perspective view similar to FIGS. 3-6, showing a series of arrows that indicate a flow of air from the atmosphere through the blower, the first rotary plate valve, the manifold assembly, and the second rotary plate valve to a microclimate management envelope.

Referring to FIGS. 3-7, the various states of the electromechanical internal components of the control unit 12 to inflate and deflate bladders 68*a-c*, 70, 72 and to pressurize envelope 74 are shown. In FIG. 3, the internal components have a first state in which right turn bladder 70 is inflated to perform the left turn assist function. In FIG. 4, the internal components have a second state in which right turn bladder 70 is deflated after the left turn assist function is completed. The internal components of control unit 12 have similar settings (not shown) for inflating and deflating left turn bladder 72 in connection with the right turn assist function. In FIG. 5, the internal components have a third state in which pressurized air bladders 68*a-c* are inflated during P&V therapy. In FIG. 6, the internal components have a fourth state in which bladders 68*a-c* are deflated during P&V therapy. In FIG. 7, the internal components have a fifth state in which pressurized air is delivered to manifold 75 and then to MCM envelope 74 during MCM therapy.

In each of FIGS. 3-7, the depicted internal components of the control unit 12 are shown to the left of the mattress overlay 32. The depicted components of the control unit 12 include a blower 92, a first rotary valve 78 coupled to an inlet and an outlet of the blower 92, and a second rotary valve 76 coupled to an outlet of the first rotary valve 78. Housing 14 of control unit 12 contains blower 92 and valves 76, 78 therein. The second rotary valve 76 includes a housing 80 having a main block 83 with a cylindrical internal chamber 82 and a cover plate 85 to which the plurality of tubes 64*a*-64*d* are coupled. Tubes 64*a-d* communicate pneumatically with chamber 82 through cover plate 85. The cover plate 85 of housing 80 is attached to block 83 with a plurality of screws 84. There is also a plurality of coil springs 88*a*-88*d* (as better shown in FIGS. 15 and 16) associated with each of the tubes 64*a*-64*d*. Springs 88*a*-88*d* bias respective annular cup seals 168*a-d* (discussed below in connection with FIGS. 15 and 16) against the rotary plate of valve 76 as will be described in further detail below. An inlet/outlet tube 86 pneumatically couples the outlet of the first rotary valve to the chamber 82 of block 83.

A stepper motor 90 is coupled to a back surface of block 83 and an output of shaft of stepper motor 90 turns a rotary plate inside passage 82 of block 83 as will be described in further detail below in connection with FIGS. 15 and 16. Basically, the position of the rotary plate within block 83 dictates whether passageway 86 is pneumatically coupled to tube 64*a*, 64*b*, 64*c* or 64*d*. Thus, the rotary plate of second rotary valve 76 has four positions. In FIGS. 3 and 4, the rotary plate of valve 76 is at a first position pneumatically coupling passageway 86 with tube 64*a* which is, in turn, pneumatically coupled to right bladder 70. In a second position (not shown) of the rotary plate of valve 76, passageway 86 is pneumatically coupled to tube 64*b* which, in turn, is coupled to left bladder 72. In FIGS. 5 and 6, the rotary plate of valve 76 is at a third position pneumatically coupling passageway 86 with tube 64*c* which is, in turn, pneumatically coupled to P&V bladders 68*a-c*. In FIG. 7, the rotary plate of valve 76 is at a fourth position pneumatically coupling passageway 86 with tube 64*d* which is, in turn, pneumatically coupled to MCM envelope 74 via manifold 75.

The first rotary valve 78 includes a rotary plate 104 sandwiched between a first manifold shell 94 and a second manifold shell 96. Shells 94, 96 couple together to form a manifold that contains rotary plate 104 therein. An inlet 93 of blower 92 pneumatically couples to a first passage (not shown) of shell 94 and an outlet 95 of blower 92 pneumatically couples to a second passage (not shown) of shell 94. A first passageway 98*a* of shell 96 pneumatically couples to passageway 86 of second rotary valve 76 and a second passageway 98*b* of shell 96 is pneumatically coupled to atmosphere. A stepper motor 100 is mounted to shell 96 and has an output shaft which turns rotary plate 104 within manifold 94, 96 of valve 78. Plate 104 has a four openings 102*a*, 102*b*, 102*c*, 102*d* therein in the illustrative example.

Depending upon the position of plate 104, the inlet 93 of blower is pneumatically coupled to one of passageways 98*a*, 98*b* and the outlet 95 of blower 92 is coupled to the other of passageways 98*a*, 98*b*. In particular, in a first position of plate 104 shown in FIGS. 3, 5 and 7, inlet 93 of blower 92 is pneumatically coupled to passageway 98*b* via opening 102*a* and outlet 95 of blower 92 is coupled to passageway 98*a* via opening 102*d*. In the first position of plate 104, openings 102*b*, 102*c* are both blocked off. In a second position of plate 104 shown in FIGS. 4 and 6, inlet 93 of blower is pneumatically coupled to passageway 98*a* via opening 102*c* and outlet 95 of blower 92 is pneumatically coupled to passageway 98*b* via opening 102*b*. In the second position of plate 104, openings 102*a*, 102*d* are blocked off. An electrical connector 106 is provided for electrically coupling blower 92 to the control circuitry of control unit 12.

In the first position of plate 104, air from the ambient is drawn into passageway 98*b* of valve 98, moved through blower 92, and then the air pressurized from blower 92 is moved through valve 78 and expelled through passageway 98*a* into chamber 82 of block 83 of valve 76 through passageway 86. The pressurized air from blower 92 received in chamber 82 of valve 76 is ultimately directed to either bladders 68*a-c*, bladder 70, bladder 72, or MCM envelope 74 depending upon the state of valve 76 as dictated by the position of the rotary plate therein. In the second position of plate 104, air from overlay 32 is drawn through valve 76 into passageway 98*a* of valve 78 and is then drawn into inlet 93 of blower 92 where it is expelled from the outlet 95 of blower 92, though valve 78, and then to the ambient through passageway 98*b*. Additional details of rotary valve 78 and the accompanying blower 92 and stepper motor 100 is shown in FIG. 72 and described in paragraphs [00208]-[00214] of International Publication No. WO 2016/159889 A1 which is hereby expressly incorporated by reference herein.

Referring once again to FIG. 3, the activation of the left turn assist function is illustrated showing the control unit 12 inflating the right turn bladder 70. In FIG. 3, rotary plate 104 of valve 78 is in the first position and the rotary plate of valve 76 is in the first position. There are several arrows illustrating the direction of airflow through the valve 78 including into the valve 76 to flow, ultimately, to bladder 70 the mattress overlay 32. For example, arrow 110 shows the direction of air flowing into passageway 98*b* from the ambient atmosphere. From the passageway 98*b*, the airflow follows arrow 114 to continue through opening 102*a* of plate 104 of valve 78 and then into inlet 93 of blower 92 through shell 94. From the blower 92, the airflow follows arrow 116 through opening 102*d* of plate 104 of valve 78 into passageway 98*a* of shell 96. From the passageway 98*a*, the airflow follows arrow 112 into passageway 86 of valve 76. From passageway 86, the airflow follows arrow 118 through valve 76 to tube 64*a*. From tube 64*a*, the airflow follows arrow 120 through hose 30 into the mattress overlay 32 to inflate the right bladder 70. The inflation of the right bladder 70 assists a patient lying on the overlay 32 to turn to the left.

Referring to FIG. 4, the deactivation of the left turn assist function resulting in the deflation of right bladder 70 is shown. In FIG. 4, the rotary plate of valve 76 remains in the first position, but rotary plate 104 is moved to the second position so that air from bladder 70 is directed to the ambient atmosphere through passageway 98*b*. In particular, the air from the right bladder 70 follows arrow 132 through hose 30 to tube 64*a*. From tube 64*a*, the airflow follows arrow 130 through chamber 82 into passageway 86. From passageway 86, the airflow follows arrow 124 into passageway 98*a* of shell 96 of valve 78. From the passageway 98*a*, the airflow follows arrow 128 through opening 102*c* of plate 104 of valve 78 into inlet 93 of blower 92. From the outlet 95 of blower 92, the airflow follows arrow 126 through opening 102*b* of plate 104 of valve 78 to passageway 98*b* of shell 96. From the passageway 98*b*, the airflow follows arrow 122 into the ambient atmosphere It should be appreciated that during activation and deactivation of the right turn assist function using left turn bladder 72, blower 92 and valve 98 are operated the same as just described above in connection with the left turn assist function. However, the rotary plate of valve 76 is moved to the second position so that air exits and enters chamber 82 of valve 76 through tube 64*b* rather than tube 64*a*. Of course, tube 64*a* is pneumatically coupled to left bladder 72 via hose 30 whereas tube 64*a* is coupled to right bladder 70. Otherwise the description above regarding the inflation and deflation of bladder 70 is equally applicable to the inflation and deflation of bladder 72.

Referring now to FIG. 5, the activation of the P&V therapy function is illustrated in connection with the portion of P&V therapy in which a pulse of air is delivered to bladders 68*a-c*. During the air pulse delivery portion of the P&V therapy, rotary plate 104 of valve 78 is in the first position and the rotary plate of valve 76 is in the third position. The pulse of air is deliver to P&V bladders 68*a-c* through a manifold 134 included in overlay 32 adjacent to one of the ends of bladders 68*a-c*. The manifold 134 directs air from tube 59*b* of hose 30 to the plurality of P&V bladders 68*a-c*. Similarly to FIG. 3, arrow 110 in FIG. 5 shows the direction of air flowing into passageway 98*b* of shell 96 of valve 78 from the ambient atmosphere. From passageway 98*b*, the airflow follows arrow 114 through opening 102*a* of plate 104 of valve 78 into inlet 93 of blower 92. From the outlet 95 of blower 92, the airflow follows arrow 116 through opening 102*d* of plate 104 into passageway 98*a* of shell 96. From passageway 98*a*, the airflow follows arrow 112 through passageway 86 into chamber 82 of valve 76. From passageway 86, the airflow follows arrow 136 to tube 64*c*. From tubes 64*c*, the airflow follows arrow 138 through tube 59*b* of hose 30 into the mattress overlay 32 to inflate a plurality of P&V bladders 68*a-c* through the manifold 134.

Referring to FIG. 6, the portion of the P&V therapy function during which the plurality of P&V bladders 68*a-c* is deflated is shown. During the deflation portion of the P&V therapy, plate 104 of valve 78 is moved to the second position and the rotary plate of valve 76 remains in the third position. During deflation, air moves from bladders 68*a-c* through manifold 134 and into tube 59*b* of a hose 30. In particular, the air exiting from manifold 134 follows arrow 142 through the hose 30 to tube 64*c* of valve 76. From tubes 64*c*, the air flow follows arrow 140 through chamber 82 to passageway 86 of the valve 76. From the passageway 86, the airflow follows arrow 124 into passageway 98*a* of shell 96 of valve 78. From the passageway 98*a*, the airflow follows arrow 128 through opening 102*c* of plate 104 of valve 78 into inlet 93 of blower 92. From the outlet 95 of blower 92, the airflow follows arrow 126 through opening 102*b* of plate 104 of valve 78 into passageway 98*b* of shell 96. From passageway 98*b*, the airflow follows arrow 122 into the ambient. Thus, during inflation of P&V bladders 68*ac*, plate 104 is in the first position and during deflation of P&V bladders 68*a-c*, plate 104 is in the second position. Plate 104 oscillates and switches rapidly between the first and second positions during P&V therapy to create high frequency pressure pulses, on the order of 5 to 20 Hertz or greater, in bladders 68*a-c*.

Referring to FIG. 7, the activation of the microclimate management (MCM) function so that air flows from control unit 12 to the MCM envelope 74 is illustrated. Similar to FIGS. 3, 5 and 7, arrows 110, 112, 114, 116 show the direction of air flowing through valve 78 from the atmosphere 31 to valve 76. Thus, during the MCM function, plate 104 of valve 78 is in the first position. However, during the MCM function shown in FIG. 7, the rotary plate in valve 76 is in the fourth position. From passageway 86, therefore, the airflow follows arrow 144 through chamber 82 of valve 76 to tube 64*d*. From tubes 64*d*, the airflow follows arrow 146 through hose 30 into the mattress overlay 32 to flow into the MCM envelope 74 through manifold 75. Because the MCM envelope 74 has a low air loss feature, there is no need to reverse the flow of air from envelope 74 or manifold 75. Thus, plate 104 of valve 78 remains in the first position when the MCM function is turned off and the pressurized air within envelope 74 bleeds to ambient atmosphere through envelope 74.

In some embodiments, blower 92 is operated in an open loop manner at a respective set speed when inflating P&V bladders 68*a-c* and pressurizing MCM envelope 74. In contrast, blower 92 is operated in a closed loop manner when inflating the left and right turn bladders 70, 72. In this regard, mattress overlay apparatus 10 includes at least one pressure sensor (see sensor 226 in FIG. 17) that senses a pressure of the air being output or pneumatically communicated to left and right turn bladders 70, 72. The pressure sensed by the pressure sensor 226 is used in connection with the closed loop control of the blower 92. Patient weight and desired time to complete inflation of the left and right turn bladders 70, 72 also may be used in connection with the closed loop control of the blower 92. The set speed of operation of the blower 92 to inflate the P&V bladders 68*a-c* may be different than the set speed of operation of the blower 92 to pressurize the MCM envelope 74, depending upon the established target pressures for the P&V and MCM functions.

As is apparent in FIGS. 3-7, rotary plate valves 76, 78 are arranged in series between the various bladders 68*a-c*, 70, 72, 74 and blower 92. Furthermore, valves 76, 78 are oriented in the illustrative embodiment such that a first axis about which rotary plate 104 of valve 78 rotates is substantially perpendicular to a second axis about which a rotary plate 170 (discussed below in connection with FIGS. 15 and 16) of valve 76 rotates. The first axis about which plate 104 rotates is defined by the output shaft of stepper motor 100 and the second axis about which plate 170 rotates is defined by the output shafts of stepper motors 90. Other arrangements of valves 76, 78 in which the first and second axes of rotary plates 104, 170 are not substantially similar are within the scope of the present disclosure.

In the illustrative embodiment of FIGS. 3-7, inflation of the P&V bladders 68*a-c*, the left turn assist bladder 72, and the right turn assist bladder 72 and the pressurization of the MCM envelope 74 is mutually exclusive such that only one of the associated P&V function, right turn assist function, left turn assist function, and MCM function is able to be operated at any given time. Similarly, deflation of P&V bladders 68*a-c*, the left turn assist bladder 72, and the right turn assist bladder 72 is mutually exclusive. The position of valve 76 determines which of the P&V function, right turn assist function, left turn assist function, and MCM function is the active function. The position of valve 78 determines whether positive pressure or negative pressure is delivered to valve 76 and ultimately, to overlay 32.

Still referring to FIGS. 3-7, blower 92 serves as an air source for mattress overlay apparatus 10. That is, blower 92 is the source of pressurized air for inflating bladders 68-*a-c*, 70, 72, 74. In the illustrative example, blower 92 also serves as a negative pressure source or vacuum for removal of air from bladders 68*a-c*, 70, 72. Alternative air sources that may be used in connection with apparatus 10 in addition to, or in lieu of, blower 92 include one or more pumps, compressors, pressurized reservoirs, a gas supply system of a healthcare facility, and so forth.

In some contemplated embodiments such as the one shown in FIGS. 3-7, the mattress overlay apparatus 10 include a vital signs sensor 77 that is integrated into the overlay 32. The vital signs sensor is located in the patient's thoracic or chest region beneath P&V bladders 68*a-c* and, in some embodiments, beneath turn assist bladders 70, 72. Vital signs sensor 77 is configured to measure heart rate and/or respiration rate, for example. Vital signs sensor 77 comprises a sheet-like capacitive sensor in some embodiments. Alternatively or additionally, sensor 77 comprises a piezoelectric sensor and/or a force sensor, such as a strain gage or a force sensitive resistor (FSR). Sensor 77 is configured to sense patient presence on the overlay 32 and/or patient absence from the overlay 32. An electrical conductor (not shown) is routed from sensor 77 to control unit 12, such as being routed along or within hose assembly 30, in some embodiments. In other embodiments, sensor 77 communicates wirelessly with control unit 12.

In some embodiments, overlay 32 has a pocket beneath P&V bladder 68*a-c* for insertion of an auxiliary support surface when P&V bladders 68*a-c* are in use. The auxiliary support surface enhances rigidity of the overlay 32 beneath P&V bladders 68*a-c*, thereby to enhance the effectiveness of the P&V function to loosen and/or dislodge mucus from the patient's lungs. The auxiliary support surface comprises a separately inflated intermediate bladder, for example. Alternatively or additionally, the auxiliary support surface may include a substantially rigid plate. In some embodiments, the pocket that receives the auxiliary support surface is also configured to receive a chest X-ray plate therein. Optionally, the pocket is accessible through an opening at a side of the overlay 32. If desired, a zipper may be coupled to the overlay 32 and may be configured to open and close the opening.

Figure 8A:
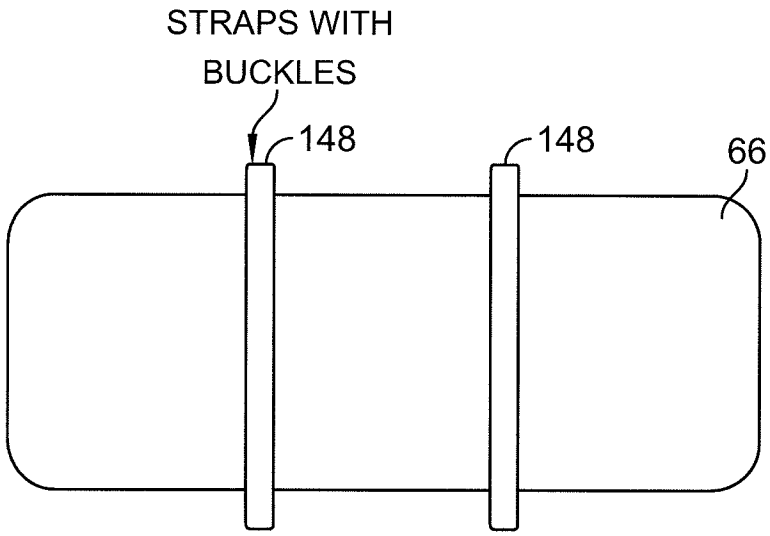
FIG. 8A is a bottom plan view of the mattress overlay coupled to the mattress using straps with buckles that wrap around a bottom of the mattress.
Figure 8B:
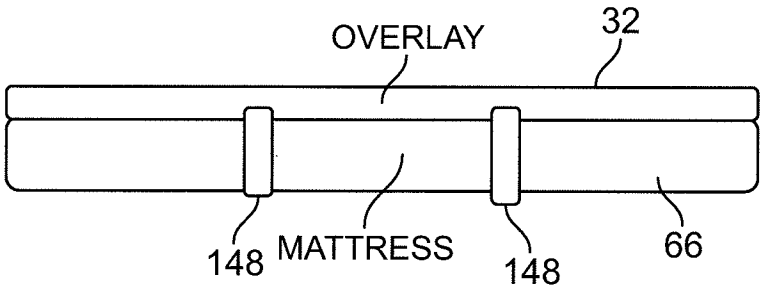
FIG. 8B is a side elevation view of the mattress and mattress overlay combination of FIG. 8A showing the mattress overlay coupled to the top of the mattress and showing the straps with buckles wrapping around a side of the mattress.

Referring now to FIGS. 8A-8D, the mattress overlay 32 is shown coupled to the mattress 66 in two different embodiments, with two views for each embodiment. In the embodiment of FIGS. 8A and 8B, couplers 148 are used to couple overlay 32 to mattress 66 and in the embodiment shown in FIGS. 8C and 8D, couplers 150 are used to couple overlay 32 to the mattress 66.

Referring now to FIGS. 8A and 8B, the first embodiment of the mattress overlay 32 coupled to the mattress 66 is shown. The mattress overlay 32 is coupled to the mattress 66 using couplers 148 which are illustratively embodied as straps with buckles 148 in this embodiment. The mattress overlay 32 includes two straps with buckles 148 in the illustrative example. In other embodiments, the mattress overlay 32 may include a different number of straps with buckles 148 to couple the mattress overlay 32 to the mattress 66. The straps with buckles 148 are coupled to the bottom of the mattress overlay 32 and wrap around the mattress 66 to provide a secure fit to the mattress 66. The straps with buckles 148 allow for slight movement of the mattress overlay 32 in relation to the mattress 66 as in the case of the inflation of the plurality of bladders 68, 70, 72 and/or articulation of a mattress support deck of bed 10. The straps with buckles 148 may be made of any material suitable for coupling the mattress overlay 32 to the mattress 66. The straps with buckles 148 are positioned more closely to the center of the mattress 66 in the illustrative embodiment. In other embodiments, the straps with buckles 148 are positioned elsewhere than the center of the mattress 66, such as more towards the ends of the overlay 32.

Figure 8C:
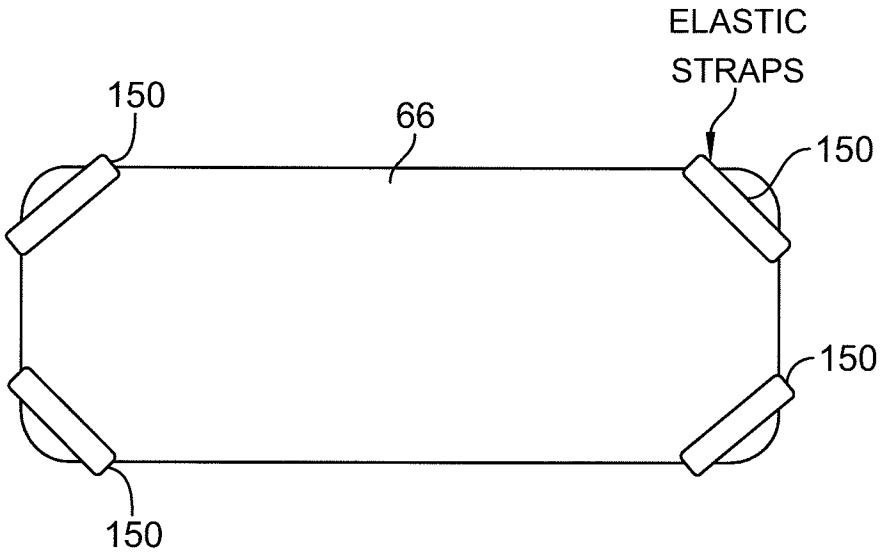
FIG. 8C is a bottom plan view of the mattress showing the mattress overlay coupled to the mattress using elastic straps that couple to the corners of the mattress.
Figure 8D:
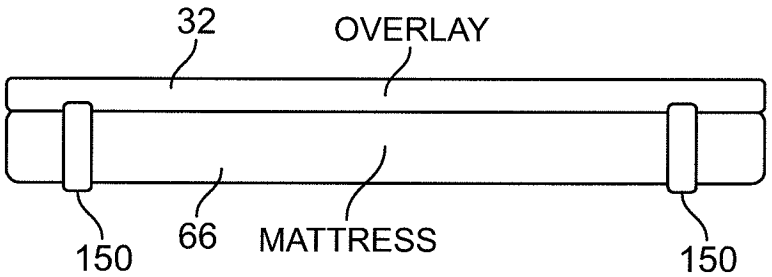
FIG. 8D is a side elevation view of the mattress and mattress overlay combination of FIG. 8C showing the mattress overlay coupled to the top of the mattress and showing two of the elastic straps wrapping around the side of the mattress.

Referring to FIGS. 8C and 8D, the second embodiment of the mattress overlay 32 coupled to the mattress 66 is shown. The mattress overlay 32 is coupled to the mattress 66 using couplers 150 which are illustratively embodied as elastic straps 150 in this embodiment. The mattress overlay 32 includes four elastic straps 150 to couple the mattress 66. In other embodiments, the mattress overlay 32 may include some other number of elastic straps 150 to couple the mattress overlay 32 to the mattress 66. The elastic straps 150 allow for slight movement of the mattress overlay 32 in relation to the mattress 66 as in the case of the inflation of the plurality of bladders 68, 70, 72 and/or the articulation of the mattress support deck of bed 10. In some embodiments, the elastic straps 150 may be made of any elastic material suitable for coupling the mattress overlay 32 to the mattress 66. The elastic straps 150 are located at the corners of the overlay 32 and are configured to wrap around the corner regions of mattress 66. In other embodiments, the elastic straps 150 may be positioned elsewhere other than the corners of the mattress 66.

Figure 9A:
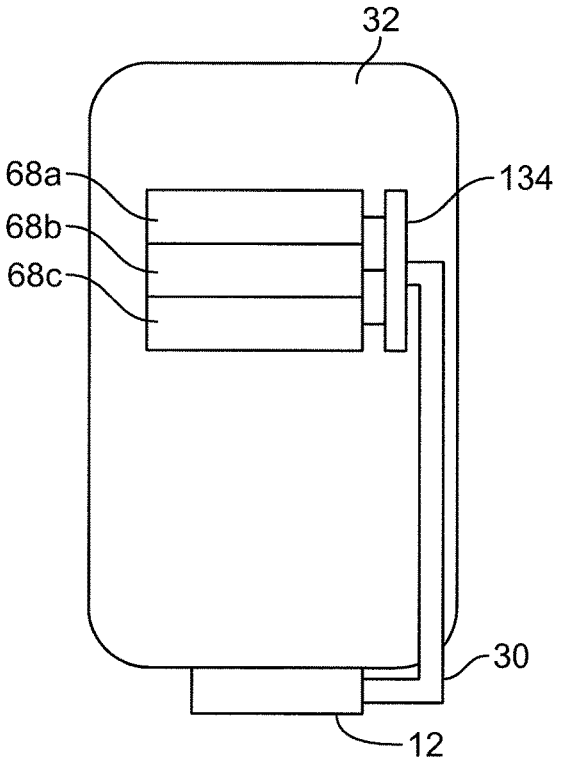
FIG. 9A is a top plan view of the mattress showing the control unit attached to an end of the mattress overlay, the control unit being pneumatically coupled through the hose and an overlay manifold to the plurality of P&V bladders that are included in the mattress overlay.
Figure 9B:
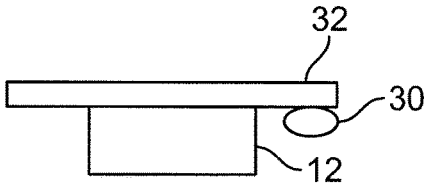
FIG. 9B is a front elevation view of the mattress overlay of FIG. 9A showing the mattress overlay above the control unit with the hose located under a right side of the mattress overlay.
Figure 9C:
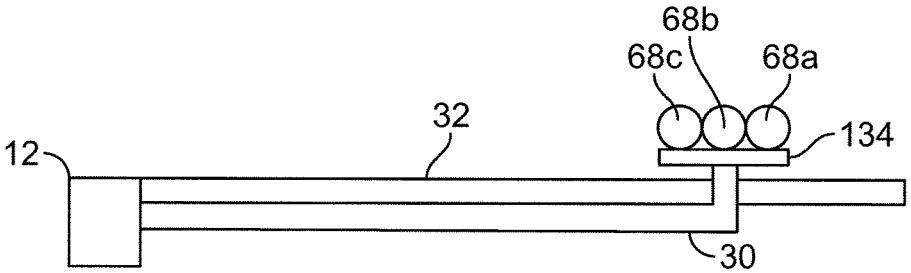
FIG. 9C is a side elevation view of the mattress of FIG. 9A showing the control unit coupled to the end of the mattress overlay and pneumatically coupled to the plurality of P&V bladders through the overlay manifold and hose that extends along the side of the mattress overlay.

Referring to FIGS. 9A-9C, the mattress overlay 32 and control unit 12 are shown. The control unit 12 is pneumatically coupled to the plurality of P&V bladders 68*a-c* through hose 30 and manifold 134. The P&V bladders 68*a-c* are positioned on the mattress overlay 32 so as to underlie a patient's chest. The control unit 12 is positioned at the foot end of the mattress overlay 32 and hose 30 is routed along a side edge of the overlay 32.

In the illustrative embodiment, hose 30 is pneumatically coupled to the manifold 134 which is, in turn, attached to the P&V bladders 68*a-c* on the left side. In other embodiments, the hose 30 may be on the right side of P&V bladders 68*a-c*. In FIG. 9B, hose 30 is positioned underneath the mattress overlay 32. In other embodiments, the hose 30 may be positioned on the right side of mattress overlay 32. The hose 30 transitions from underneath the mattress overlay 32 to the manifold 134 and P&V bladders 68*a-c* above the mattress overlay 32 as shown in FIG. 9C.

Figure 9D:
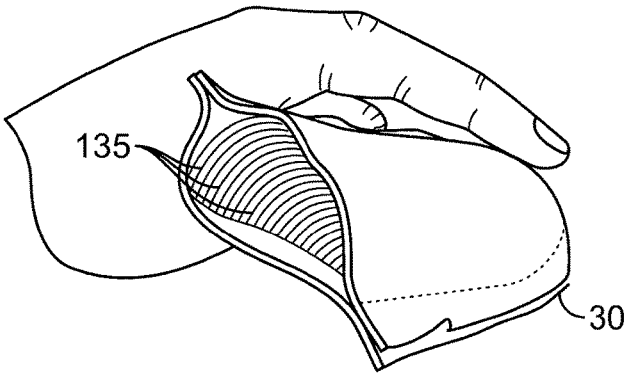
FIG. 9D is a perspective view of a portion of an interior region of the hose that pneumatically couples the control unit to the plurality of P&V bladders showing 3-dimensional (3D) engineered material situated in the interior region to resist collapsing of the hose.

Referring to FIG. 9D, a cutaway view of the hose 30 is shown. The hose 30 has three dimensional (3D) engineered material in the interior region. The 3D material includes a multitude of strands 135 that maintain the hose 30 in an opened condition but are soft enough to collapse under the weight of the patient if the patient happens to move onto hose 30. The hose 30 shown in FIG. 9D also is foldable with the overlay 32 for shipping and storage. The material of the hose 30 may be any material suitable to retain airflow but in some embodiments, the material is cloth-like, flexible material. In some embodiments, the air may flow through pipe 59*b* and then into the flexible, cloth-like hose 30 having the 3D engineered material. It is also within the scope of the present disclosure for pipe 59*d* to extend from control unit 12 to manifold 134.

Figure 9E:
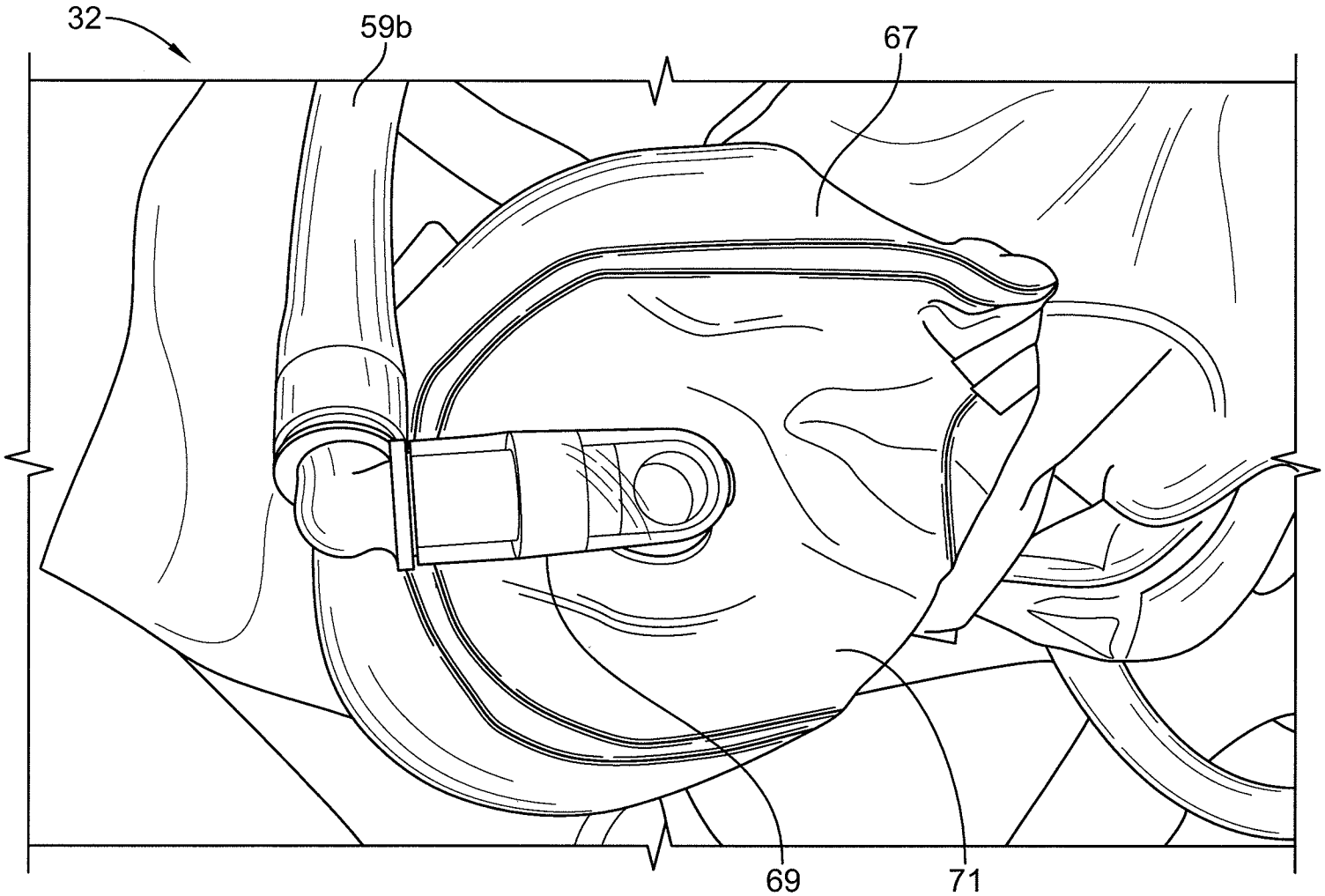
FIG. 9E is an enlarged top plan view of the connection between a hose that extends from the overlay manifold and an associated one of the P&V bladders.

Referring now to FIG. 9E, pipe 59*b* is connected to an air pocket 67 that is formed integrally with the overlay 32. An elbow joint 69 interconnects an end of pipe 59*b* to an end wall 71 of air pocket 67. Air pocket 67 leads to the plurality of P&V bladders 68*a-c*. In some embodiments, pocket 68 contains 3D engineered material therein. Air delivered through air pocket 67 inflates and deflates all three of P&V bladders 68*a-c* in some embodiments. In other embodiments, a plurality of air pockets is provided to pneumatically couple to individual P&V bladders 68*a-c* to inflate and deflate the plurality of P&V bladders 68*a-c*.

Figure 10:
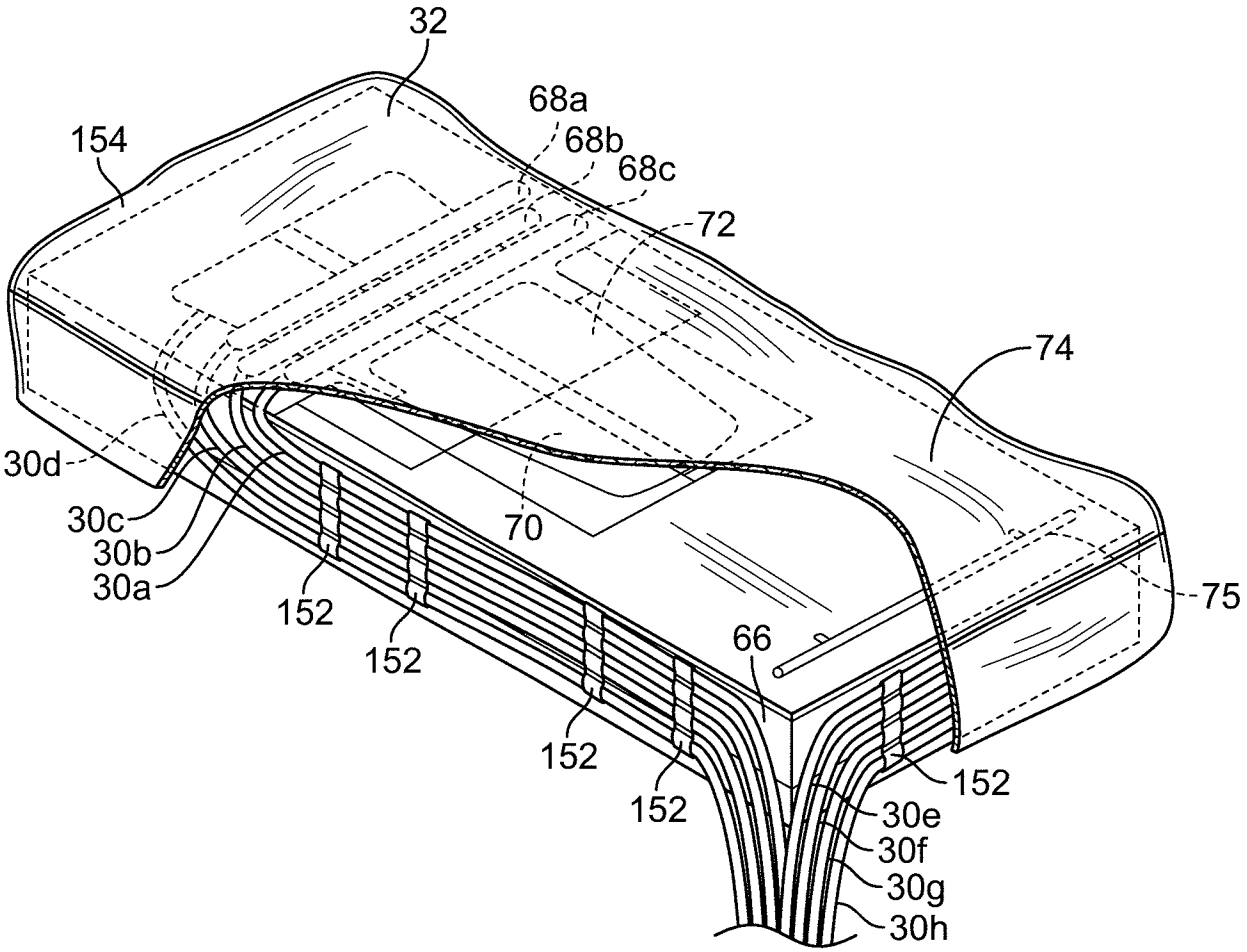
FIG. 10 is a perspective view of the mattress overlay with a portion cut away to show a plurality of hoses that are coupled to a side and an end of the mattress overlay.

Referring now to FIG. 10, mattress overlay 32 has a cover 154 and a plurality of hoses 30*a*-30*h* that are coupled to the side and end of the mattress overlay 32 by a plurality of hose straps 152. The plurality of hoses 30*a*-30*h* pneumatically couple the control unit 12 to the plurality of bladders 68*a-c*, 70, 72 and the MCM envelope 74. Straps 152 are constructed so as to define a number of loops through which hoses 30*a-h* are routed. The cover 154 extends downwardly along the sides and ends of mattress 66 to cover the plurality of hoses 30*a*-30*h*. By retaining hoses 30*a-h* with straps 152 along the sides and ends of mattress 66, the patient has less of a chance to lie on top of any of hoses 30*a-h*. Only a small portion of hoses 30*a-h* are situated on top of mattress 66 at the sides of overlay 32.

Figure 12:
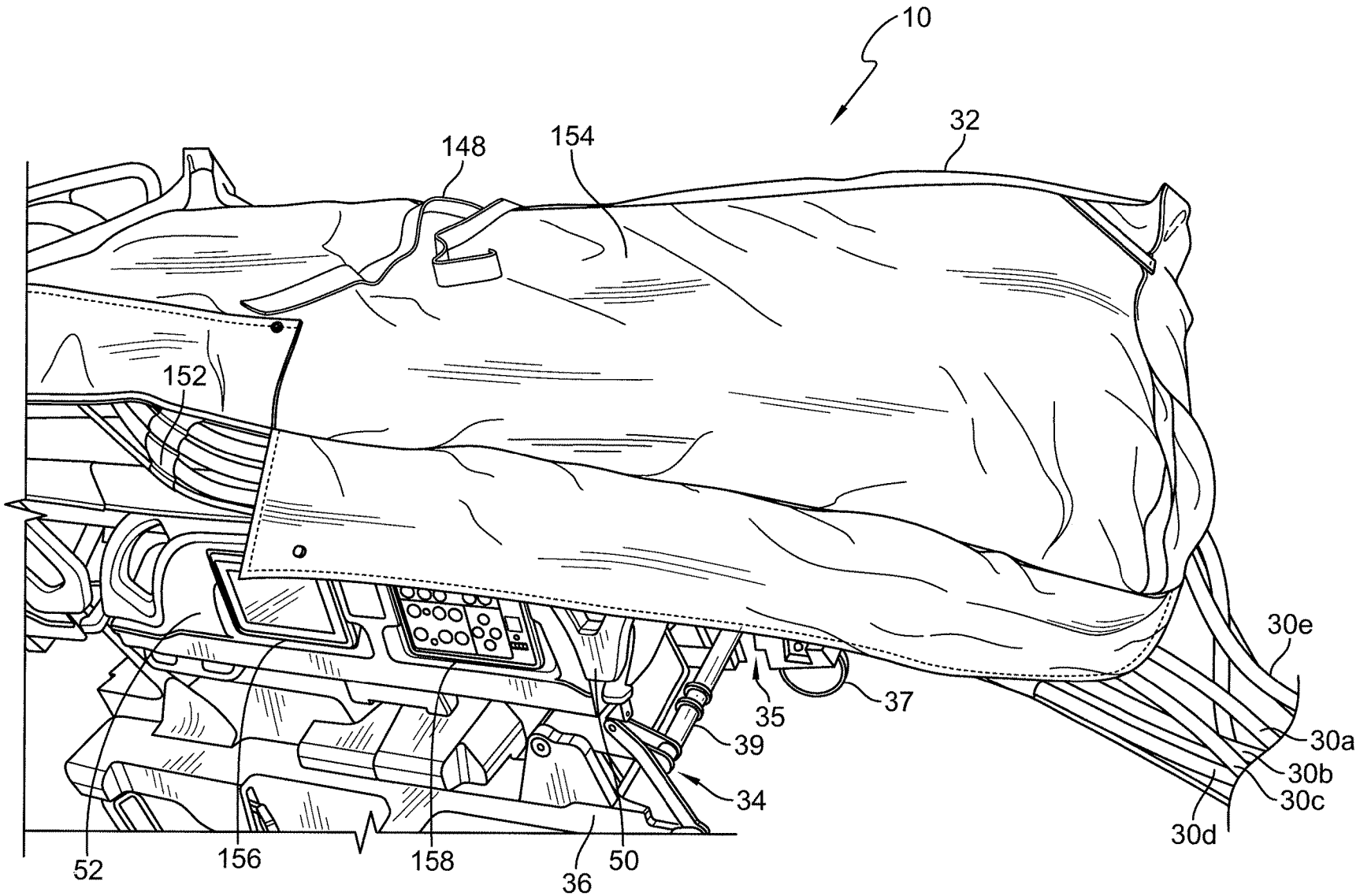
FIG. 12 is a perspective view of the side of the hospital bed, similar to FIG. 11, with the one of the flaps pulled down to cover the plurality of hoses coupled to the side of the mattress overlay.

Referring to FIG. 11, hospital bed 10 with mattress overlay 32 and mattress 66 as shown in FIG. 10 is depicted on top of the frame 34. The mattress 66 is supported by an upper frame assembly 35. The base 36 of the frame 34 supports a lift system 39 which, in turn, supports the upper frame assembly 35. The lift system 39 is operable to raise, lower, and tilt upper frame assembly 35 relative to base 36. The plurality of hoses 30*a*-30*e* are shown to be coupled to the mattress overlay 32 by the plurality of hose straps 152 as described above. In FIG. 11, the cover 154 is held back to expose the plurality of hoses 30*a*-30*e*. In use, the cover 154 is moved downwardly to cover the plurality of hoses 30*a*-30*e* as shown in FIG. 12 with regard to one of the flaps of cover 154.

Referring again to FIG. 11, the siderail assembly 50 further includes a display 156 and a user interface 158 positioned in the barrier panel 52. The display 156 provides information regarding the settings of the hospital bed 10 and has user inputs that are selected to control some functions and features of the hospital bed 10. In some embodiments, the display 156 may be used to provide inputs to the control unit 12 similarly to the graphical user interface 18 of the control unit 12 described above. The user interface 158 contains a plurality of buttons that control some functions of the hospital bed 10, such as controlling lift system 39 and controlling the movement of the mattress support deck of the upper frame assembly 35. The user interface 158 may also interact with the control unit 12 in some embodiments. The mattress overlay 32 of FIGS. 11 and 12 includes straps with buckles 148 to couple the mattress overlay 32 to the mattress 66 as described above.

Figure 13:
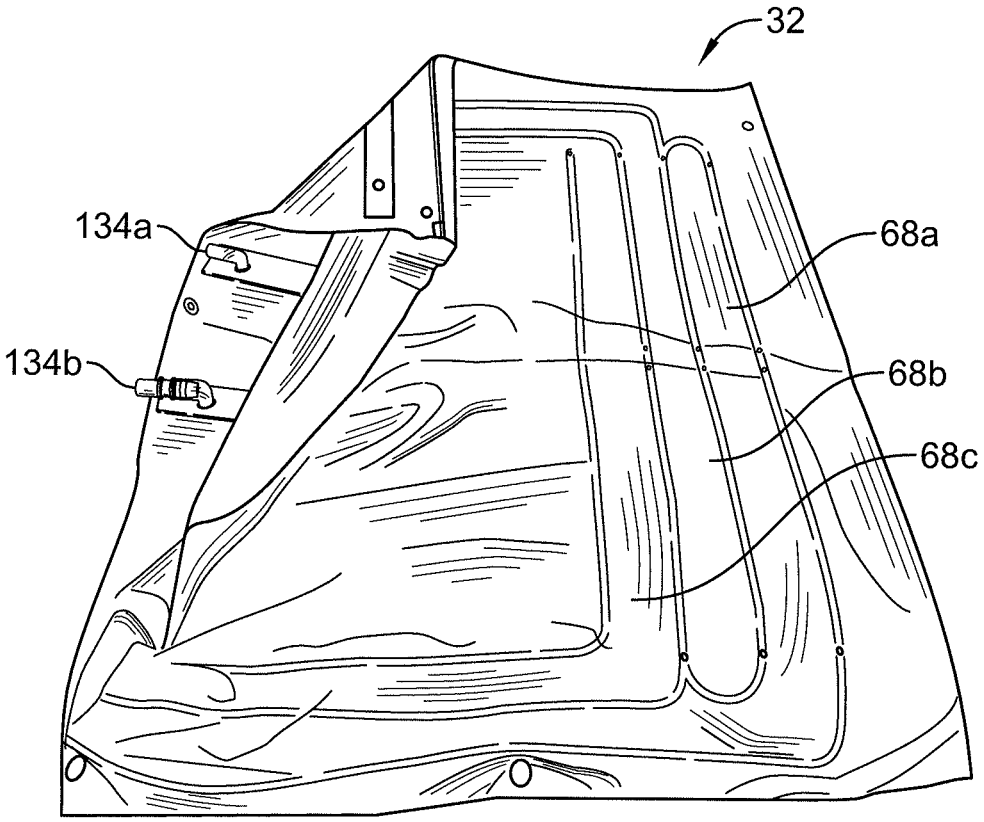
FIG. 13 is a perspective view of an alternative embodiment of the mattress overlay in which the P&V bladders and associated air delivery conduits are formed by welds between sheets of the mattress overlay.
Figure 14:
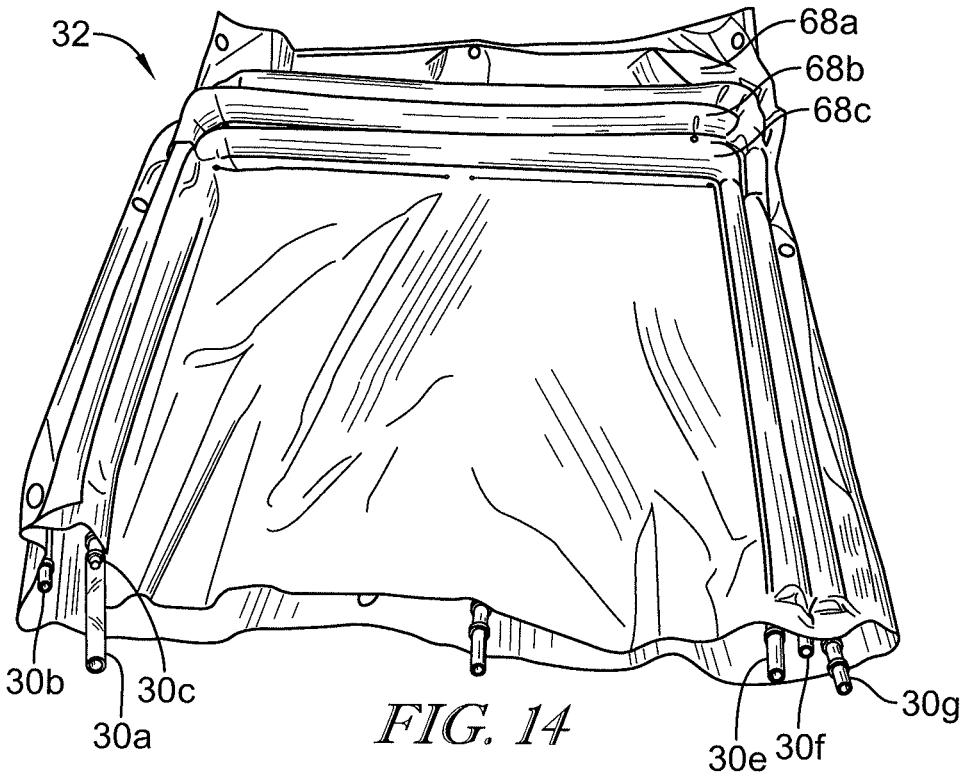
FIG. 14 is a perspective view of the mattress overlay of FIG. 13 showing the plurality of P&V bladders and the associated conduits inflated.

Referring to FIG. 13, a section of the mattress overlay 32 with the P&V bladders 68*a-c* is shown. The P&V bladders 68 are inflated through two hose connectors 134*a*, 134*b*. The two hose connectors 134*a*, 134*b* may be coupled to two of the plurality of hoses 30*a*-30*h* to pneumatically couple the control unit 12 to the plurality of P&V bladders 68*a-c* as described above. In some embodiments such as the one shown in FIG. 13, P&V bladders 68*a-c* are formed by coupling together, such as at the illustrative weld lines, a first layer of material of the overlay 32 and a second layer of material of the overlay 32 such that the P&V bladders 68*a-c* extend laterally across a majority of a width of the overlay 32 and such that conduits through which air is delivered to the P&V bladders 68*a-c* are defined between the first and second layers along opposite longitudinal sides of the overlay 32. Alternatively, such conduits formed by overlay material may all be situated along the same longitudinal side of the overlay 32. Referring to FIG. 14, an embodiment is shown in which P&V bladders 68*a-c* are inflated using hoses 30*a-c*, 30*e-g* that are routed through respective air pockets at the opposite sides of overlay 32, there being three hoses 30*a-c* on the right side of overlay 32 and three hoses 30*e-g* on the left side of overlay 32.

Figure 15:
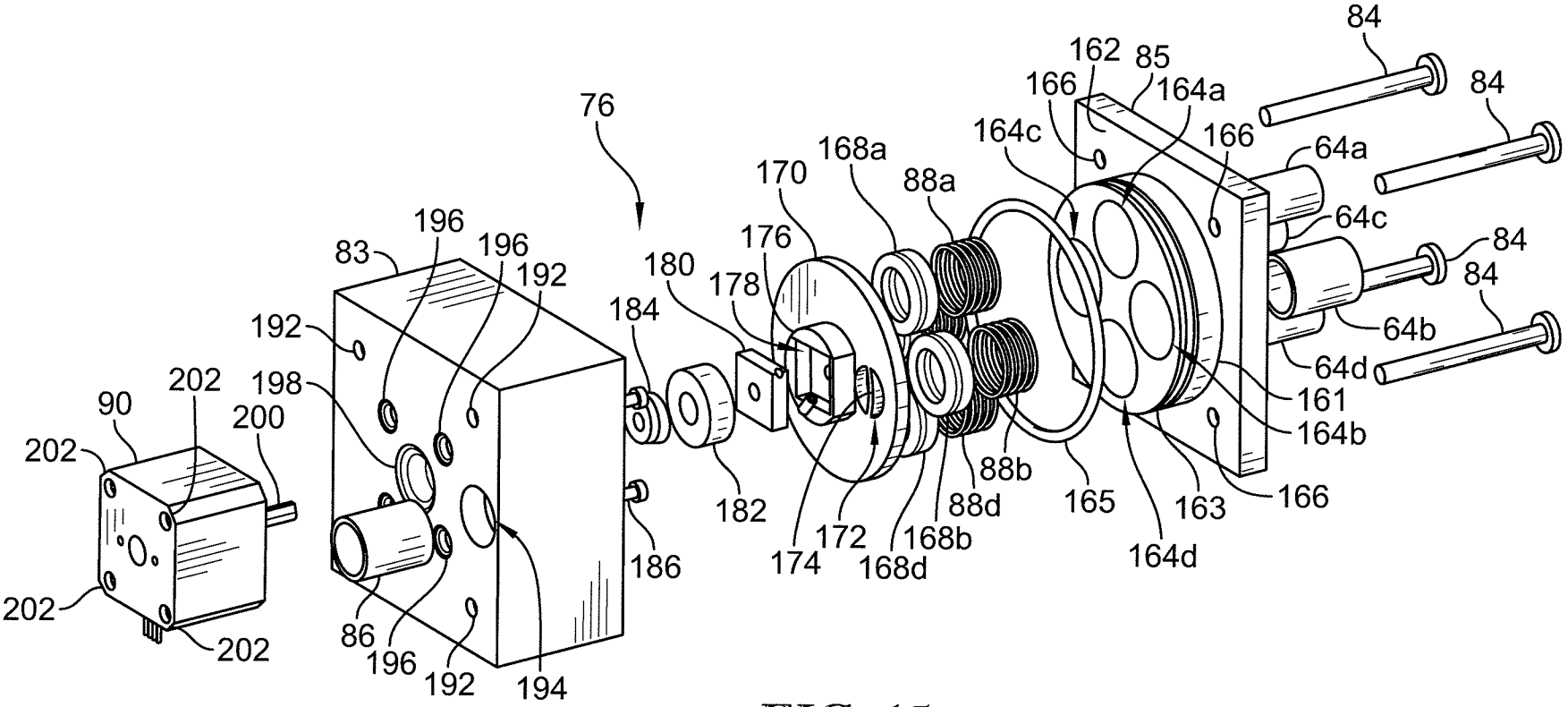
FIG. 15 is an exploded perspective view of the second rotary plate valve of the control unit showing a stepper motor on the left side of a manifold block of the second rotary plate valve.
Figure 16:
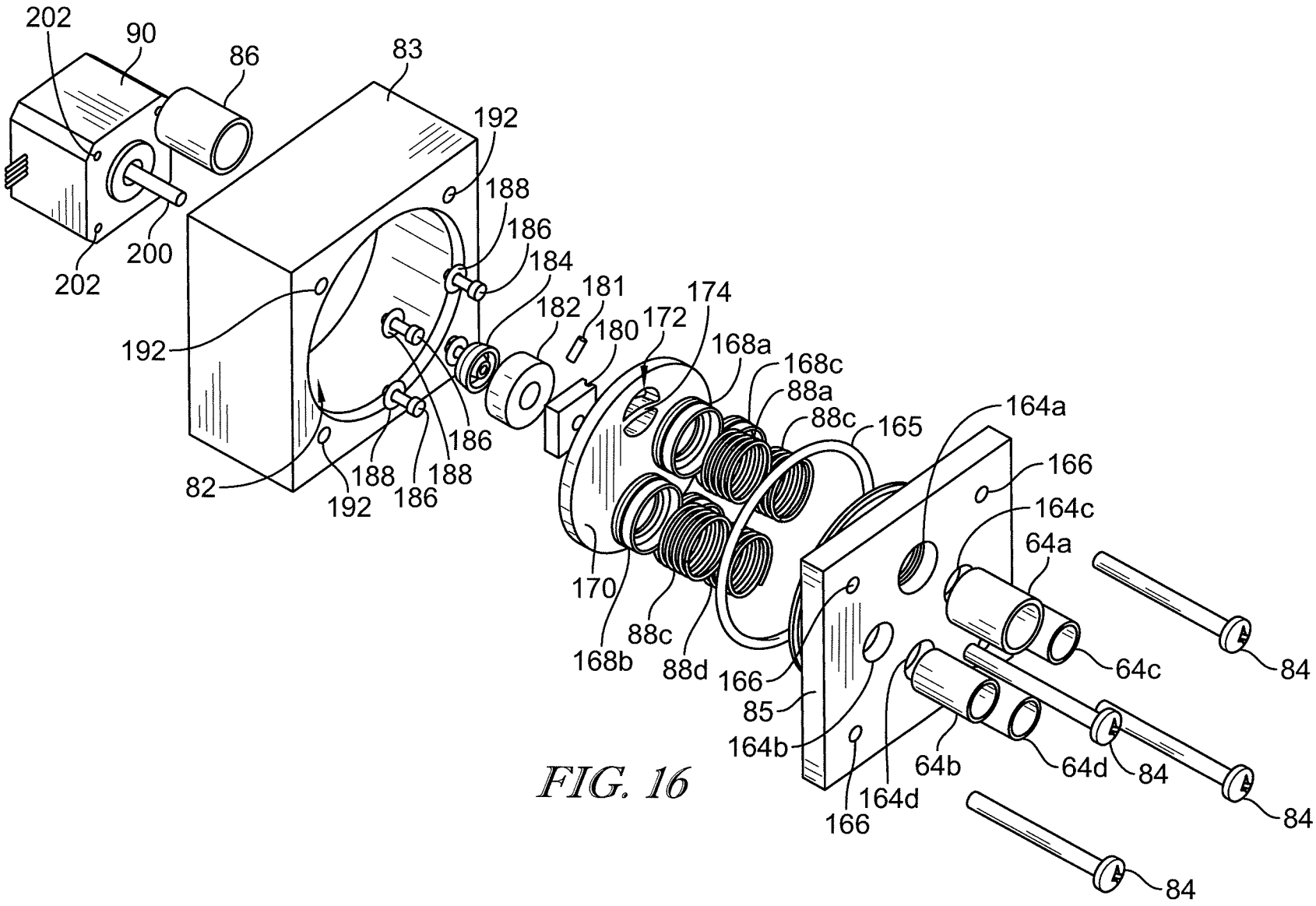
FIG. 16 is another exploded perspective view of the second rotary plate valve that is viewed in a different direction than the exploded perspective view of FIG. 15.

Referring now to FIG. 15, the second rotary valve 76 of control unit 12 is shown. Valve 76 includes a first stepper motor 90, cover 85, main block 83, and a rotatable plate 170. There are further components sandwiched between the cover 85 and rotatable plate 170 and between the rotatable plate 170 and main block 83. The main block 83 and cover 85 are square in shape and the cover 85 has a flange 162 with a circular portion 161 projecting therefrom and having cylindrical holes 164*a*-164*d* to receive the tubes 64*a*-64*d*. The rotatable plate 170 is round in shape.

Flange 162 of cover 85 has four holes 166 to receive screws 84 to couple cover 85 to main block 83. The circular portion 161 of the cover 85 has a groove 163 that receives an O-ring 165. The O-ring 165 is made of a rubber or elastic material to provide sealing engagement between portion 161 of cover 85 and the inner surface of chamber 82. Thus, ring 165 provides a seal to prevent air from leaking from valve 76 during operation of the control unit 12. The tubular holes 164*a*-164*d* correspond to particular tubes 64*a*-64*d* so that air may be directed to the plurality of P&V bladders 68*a-c*, turn assist bladder 70, turn assist bladder 72 or MCM envelope 74.

The rotatable plate 170 includes a hole 172 to allow for air flow through the rotatable plate 170 and a raised portion 176 that has a square hole 178 to receive a square block 180 to provide torque to the rotatable plate 170 from the first stepper motor 90. Rotary plate 170 includes a bar 174 across hole 172 to prevent cup seals 168*a*-168*d* sandwiched between the cover 85 and the rotatable plate 170 from herniating when the hole 172 is moved across the cup seals 168*a*-168*d*. Bar 174 bifurcates or separates hole 172 into two hole portions with each hole portion being on one side of bar 174 or the other. Springs 88*a*-88*d* bias the respective cup seals 168*a*-168*d* into engagement with the rotatable plate 170. The bar 174 comprises a curved piece across the hole 172 in the illustrative embodiment. Alternatively or additionally, the bar 174 may include straight portions. Bar 174, therefore, serves as an anti-herniation appendage situated in hole 172. In the illustrative embodiment, bar 174 extends all the way across 172.

The main block 83 includes four holes 192 that align with holes 166 of the first stationary plate 160 that receive the screws 84 to couple the cover 85 and the main block 83 together. The main block 83 includes an opening 194 to receive the passageway 86 therein. The passageway 86 couples the first rotary valve 78 to the second rotary valve 76 as described above. The main block 83 includes four holes 196 that receive suitable fasteners, such as bolts or screws 186, to couple the first stepper motor 90 to main block 83. The main block 83 also includes an opening 198 to receive an output shaft 200 of the first stepper motor 90. The first stepper motor 90 includes holes 202 to align with the holes 196 of the main block 83. Screws 186 are received in holes 196 of main block 83 and holes 202 of the first stepper motor 90.

The cover 85 and the rotatable plate 170 have springs 88*a*-88*d* compressed therebetween and in engagement with cup seals 168*a*-168*d* that align with the holes 164*a*-164*d* and the tubes 64*a*-64*d*. Thus, springs 88*a*-88*d* are compressed between cover 85 and the respective cup seal 168*a*-168*d*, each of which is, in turn, biased against rotary plate 170. The hole 172 of plate 170 rotates with the output shaft 200 to be positioned in alignment with one of the holes 164*a*-164*d* to allow airflow to the respective tube 64*a-d* which are, in turn, pneumatically coupled to respective bladders 68*a-c*, 70, 72 or MCM envelope 74.

A thrust bearing 182 is situated between the rotatable plate 170 and the main block 83 and helps to maintain the square portion 180 within the hole 178. A shaft seal 184 attaches to a distal end of the output shaft 200 and abuts the thrust bearing 182. The thrust bearing 182 abuts the square block 180. The first stepper motor 90 rotates the rotatable plate 170 through the output shaft 200 and the square block 180 received in the hole 178 of the rotatable plate 170. As shown in FIG. 16, main block 83 has cylindrical chamber 82 which receives the internal components of the valve 76. A set screw 181 is provided to couple square block 180 to raised portion 176 of plate 170. Set screw 181 threads through raised portion 176 and into a hole formed at a corner region of the square block 180.

Figure 17:
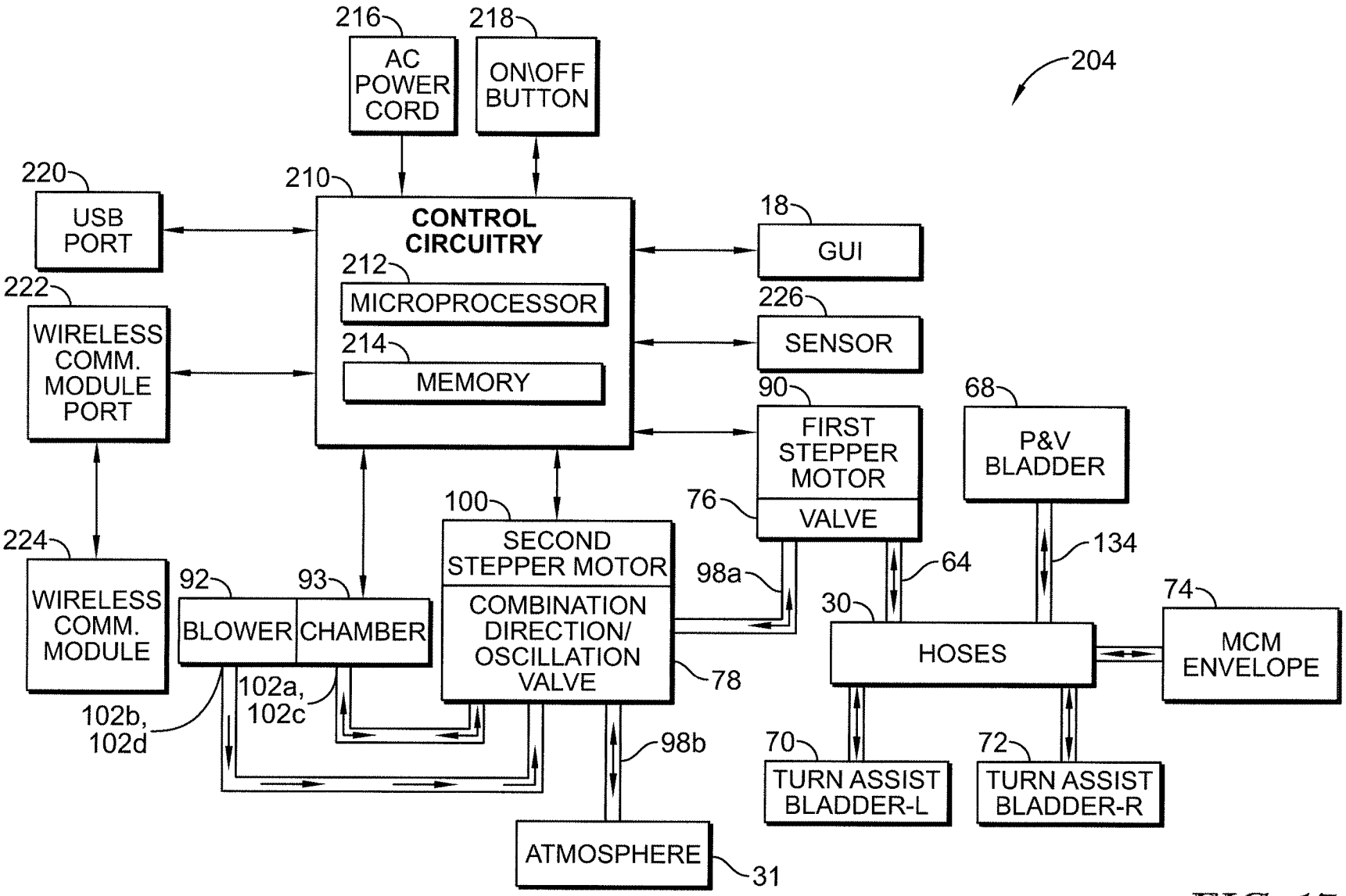
FIG. 17 is a block diagram of the control unit and mattress overlay.

Referring now to FIG. 17, a diagrammatic view of the electrical system 204 and pneumatic system 76, 78, 92 of control unit 12 is provided. Electrical system 204 includes control circuitry 210 which, in turn, includes a microprocessor 212 and memory 214. In some embodiments, microprocessor 212 and memory 214 are part of a single microcontroller integrated circuit chip. As shown in FIG. 17, GUI 18, on/off button 218, sensors 226, USB port 220, and wireless communication module 224 are coupled electrically to control circuitry 210. A wireless communication module port 222 is shown diagrammatically and provides the communication link between module 224 and circuitry 210.

An alternating current (AC) power cord 216 is also coupled to circuitry 210. Circuitry 210, therefore, includes components to convert the incoming AC power to the proper voltage levels, e.g., 5 Volts (V), 12 V, 24 V, etc., required by various components of systems 76, 78, 92, 204. In some embodiments, control unit 12 includes a lithium ion battery pack which is charged while power cord 216 is plugged into a power outlet. In some such embodiments, the components of control unit 12 are powered from the lithium ion battery pack regardless of whether cord 216 is plugged into a power outlet. Battery packs or batteries that operate according to technologies other than lithium ion technology are also within the scope of this disclosure for use in control unit 12.

It should be appreciated that although circuitry 210 is shown diagrammatically as a single block in FIG. 17, it is within the scope of this disclosure for circuitry 210 to include electrical components that are provided on multiple, separate circuit boards which are interconnected via suitable conductors. It is also within the scope of this disclosure for circuitry 210 to comprise a single circuit board with the associated electrical components mounted thereon. Of course, some components of electrical system 204 may not be attached to any circuit board at all. For example, button 218, USB port 220, and wireless communication module port 222 may be physically mounted to housing 14 rather than to a circuit board. Ultimately, however, suitable conductors connect these components to control circuitry 210.

In FIG. 17, the double headed arrows leading between circuitry 210 and the various other components are intended to imply that bidirectional or two-way communication occurs between circuitry 210 and the associated components. However, this is not to exclude the possibility that other embodiments of control unit 12 may have one-way communication between circuitry 210 and one or more of the other elements. Similarly, the one-way arrow from power cord 216 is not intended to exclude the possibility of two-way communication between circuitry 210 and these components in other embodiments. For example, data over power line communication technology may be employed, if desired, to transmit signals from circuitry 210 over AC power cord 216 away from control unit 12.

Still referring to FIG. 17, blower 92, inlet 93, and the combination direction/oscillation valve 78 pneumatically coupled to the blower 92 and chamber 93 are shown. Valve 78 includes second stepper motor 100 that controls movement of rotary valve plate 104 of valve 78 as discussed above. Valve 78 couples to valve 76 through passageway 98*a* which directs air to a hose 30 which, in turn, directs air to the plurality of bladders 68*a-c*, 70, 72 and MCM envelope 74 through one of a plurality of passageways 64*a*-64*d* and manifold 134. Valve 76 includes a first stepper motor 90 that controls movement of rotatable plate 170 to direct airflow to one of the plurality of passageways 64*a*-64*d* as discussed above. Valve 78 also includes a passageway 98*b* that couples to atmosphere 31.

One or more sensors 226 are placed in pneumatic communication with any of the passageways 98*a*, 98*b*, 64, hose 30, and manifold 134 and are in electrical communication with control circuitry 210 via suitable conductors. Thus, one could allocate sensor(s) 226 as being a component of either electrical system 204 or pneumatic system 76, 78, 92 or both. The one or more sensors 226 may further be placed in pneumatic communication with other components such as the blower 92. Sensor(s) 226 include a pressure sensor or a flow sensor or both. Suitable electrical conductors also interconnect blower 92, first stepper motor 90, and second stepper motor 100 to circuitry 210. In general, conductors communicate control signals from circuitry 210 to blower 92, first stepper motor 90, second stepper motor 100 and communicate feedback signals from blower 92, first stepper motor 90, and second stepper motor 100 to circuitry 210.

Examples of feedback signals from blower 92 include rotational speed of an impeller of the blower 92 and the temperature of the blower 92. The control signal to the blower 92 may include, for example, a voltage signal such as a pulse width modulated (PWM) signal. Examples of feedback signals from one of the stepper motors 90, 100 include a step count number indicative of a position of an output shaft of one of the motors 90, 100 and a temperature of one of the motors 90,100. The control signal to one of the motors 90, 100 may include, for example, a voltage pulse to move the motor output shaft by one step or a series of pulses to move the motor output shaft by a corresponding number of steps.

When positive pressure produced at an outlet of blower 92, defined by a an opening 102*a* of valve 78, is to be supplied to the plurality of bladders 68, 70, 72 or MCM envelope 74, valve 78 is operated so that pressurized air from blower 92 is communicated to one of the plurality of bladders 68, 70, 72 or MCM envelope 74. When negative pressure produced at inlet 93 of the blower 92, defined by opening 102*b*, is to be supplied to the plurality of bladders 68, 70, 72 or MCM envelope 74, valve 78 is operated so that suction from blower 92 is communicated from passageway 98*a* to withdraw air from the plurality of bladders 68, 70, 72 or the MCM envelope 74.

FIG. 17 has one-way arrows to show that blower 92 is pneumatically coupled to rotary valve 78 to indicate a direction of flow of air to or from the blower 92, whereas bidirectional arrows are shown in passageways 98*a*, 98*b*, 64, 134 to indicate that air is sometimes flowing from valve 78 toward the plurality of bladders 68, 70, 72, MCM envelope 74, or atmosphere 31 and that air is sometimes flowing from valve 78 away from the plurality of bladders 68, 70, 72, MCM envelope 74, or atmosphere 31. Valve 78 is operable to switch between a positive pressure position in which air is drawn from atmosphere 31 to be pressurized by blower 92 for delivery to the plurality of bladders 68, 70, 72, or MCM envelope 74 and a negative pressure position in which air is drawn from the plurality of bladders 68, 70, 72, or MCM envelope 74 and is blown to atmosphere 31 by blower 92.

According to this disclosure, valve 78 is also operable while in the positive pressure position and/or the negative pressure position to produce oscillations in the pressure being delivered to P&V bladders 68. It is contemplated by this disclosure that, in some embodiments, only the second stepper motor 100 is used in control unit 12 to control whether valve 94 is in the positive pressure position or the negative pressure position and to control whether the valve 94 produces oscillations while in either of these positions.

Although certain illustrative embodiments have been described in detail above, many embodiments, variations and modifications are possible that are still within the scope and spirit of this disclosure as described herein and as defined in the following claims.

The invention claimed is:

1. A mattress overlay apparatus for use with a mattress, the mattress overlay apparatus comprising:

an overlay configured for placement atop the mattress and having a plurality of inflatable bladders;

a blower; and first and second rotary plate valves pneumatically coupled to the plurality of bladders and the blower, the first and second rotary plate valves being arranged in series between the plurality of bladders and the blower;

wherein the blower has an inlet and an outlet; the first rotary valve includes a first rotary plate that is movable between a first position and a second position; when the first rotary plate is in the first position, the inlet of the blower is coupled to atmosphere and the outlet of blower is coupled to the second rotary plate valve so that positive pressure produced at the outlet of the blower is applied to the second rotary plate valve; and when the first rotary plate is in the second position, the outlet of the blower is coupled to atmosphere and the inlet of the blower is coupled to the second rotary plate valve so that negative pressure produced at the inlet of the blower is applied to the second rotary plate valve, wherein the second rotary plate valve includes a second rotary plate that is movable between first, second, third, and fourth positions; the plurality of inflatable bladders includes at least one percussion and vibration (P&V) bladder, a left turn bladder, a right turn bladder, and a microclimate management (MCM) envelope; when the second rotary plate is in the first position and the first rotary plate is in the first position, the blower is operable to inflate the at least one P&V bladder; when the second rotary plate is in the second position and the first rotary plate is in the first position, the blower is operable to inflate the left turn bladder; when the second rotary plate is in the third position and the first rotary plate is in the first position, the blower is operable to inflate the right turn bladder; and when the second rotary plate is in the fourth position and the first rotary plate is in the first position, the blower is operable to move air through the MCM envelope.

2. The mattress overlay apparatus of claim 1, wherein when the second rotary plate is in the first position and the first rotary plate is in the second position, the blower is operable to deflate the at least one P&V bladder; when the second rotary plate is in the second position and the first rotary plate is in the second position, the blower is operable to deflate the left turn bladder; and when the second rotary plate is in the third position and the first rotary plate is in the second position, the blower is operable to deflate the right turn bladder.

3. The mattress overlay apparatus of claim 1, wherein when the second rotary plate of the second rotary plate valve is in a P&V position, the first rotary plate is oscillated between a first position in which positive pressure at an outlet of the blower is applied to the at least one P&V bladder to inflate the at least one P&V bladder and a second position in which negative pressure at an inlet of the blower is applied to the at least one P&V bladder to deflate the at least one P&V bladder.

4. The mattress overlay apparatus of claim 3, wherein a frequency at which the first rotary plate oscillates between the first and second positions is selectable from between about 5 Hertz to about 20 Hertz.

5. The mattress overlay apparatus of claim 3, further comprising a conduit through which the second rotary plate valve pneumatically communicates with the at least one P&V bladder, the conduit comprising a tube made of cloth-like, flexible material and a quantity of 3-dimensional (3D) engineered material within the tube to prevent the tube from collapsing.

6. The mattress overlay apparatus of claim 1, further comprising a housing in which the blower, the first rotary plate valve, and the second rotary plate valve are contained, the second rotary plate valve having a set of four output ports accessible at an exterior of the housing, and further comprising a hose assembly having four hoses and a hose adapter that attaches to the housing so that the four hoses substantially simultaneously couple to the set of four output ports of the second rotary plate valve.

7. The mattress overlay apparatus of claim 6, wherein the at least one P&V bladder is pneumatically coupled to a first hose of the set of four hoses, the left turn bladder is pneumatically coupled to a second hose of the set of four hoses, the right turn bladder pneumatically coupled to a third hose of the set of four hoses, and the MCM envelope is pneumatically coupled to a fourth hose of the set of four hoses.

8. The mattress overlay apparatus of claim 7, wherein the first hose is strengthened with a coil of wire due to the blower being operated to inflate the at least one P&V bladder at a higher pressure than is used to inflate the left turn bladder, the right turn bladder, and the MCM envelope.

9. The mattress overlay apparatus of claim 8, wherein the pressure applied by the blower to the at least one P&V bladder via the first hose is about 70 to about 80 $cmH_2O$ at a high intensity setting, the pressure applied by the blower to the left and right turn bladders via the second and third hoses, respectively, is about 30 to about 40 $cmH_2O$, and the pressure applied by the blower to the MCM envelope via the fourth hose is about 20 to about 30 $cmH_2O$.

10. The mattress overlay apparatus of claim 6, further comprising a graphical user interface (GUI) accessible on the housing, the graphical user interface displaying a first touch button that is selected to activate a percussion and vibration (P&V) function of the overlay, a second touch button that is selected to activate a left turn assist function of the overlay, a third touch button that is selected to activate a right turn assist function of the overlay, and a fourth touch button that is selected to activate a microclimate management (MCM) function of the overlay.

11. The mattress overlay apparatus of claim 10, wherein the GUI displays an off button that is selected to turn off any ongoing function whether the ongoing function is the P&V function, left turn assist function, right turn assist function, and MCM function, or any combination thereof.

12. The mattress overlay apparatus of claim 10, wherein operation of each of the P&V function, left turn assist function, right turn assist function, and MCM function are mutually exclusive such that only one of the P&V function, left turn assist function, right turn assist function, and MCM function is able to be operated at any given time.

13. The mattress overlay apparatus of claim 1, wherein the first rotary plate is moved by a first stepper motor and the second rotary plate that is moved by a second stepper motor.

14. The mattress overlay apparatus of claim 13, wherein a first axis of rotation of the first rotary plate is substantially perpendicular to a second axis of rotation of the second rotary plate.

15. The mattress overlay apparatus of claim 1, wherein the second rotary plate valve has a plurality of outlet ports and the second rotary plate has a hole that is selectively alignable with each outlet port of the plurality of outlet ports.

16. The mattress overlay apparatus of claim 15, wherein the second rotary plate valve has a plurality of cup seals that are spring biased against the second rotary plate, wherein the second rotary plate includes a bar that extends across the hole thereby to separate the hole into two hole portions, and wherein the bar prevents seal herniation of the cup seals as the rotary plate is rotated.

17. The mattress overlay apparatus of claim 16, wherein each cup seal of the plurality of cup seals is aligned with a respective outlet port of the plurality of outlet ports.

18. The mattress overlay apparatus of claim 16, wherein at least a portion of the bar extending across the hole is curved.

19. The mattress overlay apparatus of claim 1, further comprising a vital signs sensor integrated into the overlay and configured to measure at least one or both of heart rate and respiration rate.

20. The mattress overlay apparatus of claim 1, further comprising a patient presence sensor integrated into the overlay.

* * * * *